US011520280B1

(12) United States Patent
Tanaka et al.

(10) Patent No.: US 11,520,280 B1
(45) Date of Patent: Dec. 6, 2022

(54) IMAGE FORMING APPARATUS

(71) Applicant: FUJIFILM Business Innovation Corp., Tokyo (JP)

(72) Inventors: Arichika Tanaka, Kanagawa (JP); Shohei Miyagawa, Kanagawa (JP); Go Miura, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/567,228

(22) Filed: Jan. 3, 2022

(30) Foreign Application Priority Data

Aug. 25, 2021 (JP) ..... JP2021-137495

(51) Int. Cl.
*G03G 15/04* (2006.01)
*G03G 21/16* (2006.01)
*G03G 21/00* (2006.01)

(52) U.S. Cl.
CPC ..... *G03G 21/1642* (2013.01); *G03G 21/0005* (2013.01); *G03G 21/1676* (2013.01)

(58) Field of Classification Search
CPC ..... G03G 21/0005; G03G 21/1642; G03G 21/1676
USPC ..... 399/107, 110, 111, 119, 302, 308
See application file for complete search history.

(56) References Cited

U.S. PATENT DOCUMENTS 10,969,732 B2 * 4/2021 Suzuki ..... G03G 21/1867

FOREIGN PATENT DOCUMENTS

JP 2011-123449 A 6/2011

* cited by examiner

*Primary Examiner* — Hoan H Tran
(74) *Attorney, Agent, or Firm* — Oliff PLC

(57) ABSTRACT

An image forming apparatus includes a belt component, a first detachable unit that faces the belt component in an area where an outer surface of the belt component faces upward, a first housing component that houses the first detachable unit and is drawable from and loadable into the apparatus, a second detachable unit that faces the belt component in an area where the outer surface of the belt component faces downward, and a second housing component that houses the second detachable unit and is drawable from and loadable into the apparatus. With the first housing component being drawn from the apparatus, the first detachable unit is detachable from and attachable to the first housing component in a side-to-side direction. With the second housing component being drawn from the apparatus, the second detachable unit is detachable from and attachable to the second housing component in an upward direction.

20 Claims, 13 Drawing Sheets

IMAGE FORMING APPARATUS

CROSS-REFERENCE TO RELATED APPLICATIONS

This application is based on and claims priority under 35 USC 119 from Japanese Patent Application No. 2021-137495 filed Aug. 25, 2021.

BACKGROUND

(i) Technical Field

The present disclosure relates to an image forming apparatus.

(ii) Related Art

A technology relating to a structure of an image forming apparatus that allows a component such as an exchangeable one to be detached from and attached to the body of the apparatus is disclosed by Japanese Unexamined Patent Application Publication No. 2011-123449 ([0093] to [0102] and FIGS. 49 to 53).

According to Japanese Unexamined Patent Application Publication No. 2011-123449, with a marking module (1) drawn out at the front of the apparatus, individual developing units (Gg, Go, Gy, Gm, Gc, and Gk) are detachable from the apparatus by being moved in the horizontal direction toward a first side, whereas individual photoconductor units (Ug, Uo, Uy, Um, Uc, and Uk) are detachable from the apparatus by being moved in the horizontal direction toward a second side, which is opposite the first side.

SUMMARY

Aspects of non-limiting embodiments of the present disclosure relate to a structure including a first detachable unit that faces a belt component in an area where the outer surface of the belt component faces upward, and a second detachable unit that faces the belt component in an area where the outer surface of the belt component faces downward, in which the structure provides increased ease of handling of the detachable units, compared with a structure including detachable units all employing the same detachable mechanism.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including a belt component, a first detachable unit that faces the belt component in an area where an outer surface of the belt component faces upward, a first housing component that houses the first detachable unit and is drawable from and loadable into the apparatus, a second detachable unit that faces the belt component in an area where the outer surface of the belt component faces downward, and a second housing component that houses the second detachable unit and is drawable from and loadable into the apparatus, wherein with the first housing component being drawn from the apparatus, the first detachable unit is detachable from and attachable to the first housing component in a side-to-side direction, and wherein with the second housing component being drawn from the apparatus, the second detachable unit is detachable from and attachable to the second housing component in an upward direction.

BRIEF DESCRIPTION OF THE DRAWINGS

An exemplary embodiment of the present disclosure will be described in detail based on the following figures, wherein.

DETAILED DESCRIPTION

While an exemplary embodiment of the present disclosure will be described with reference to the accompanying drawings, the present disclosure is not limited to the following exemplary embodiment.

Figure 1:
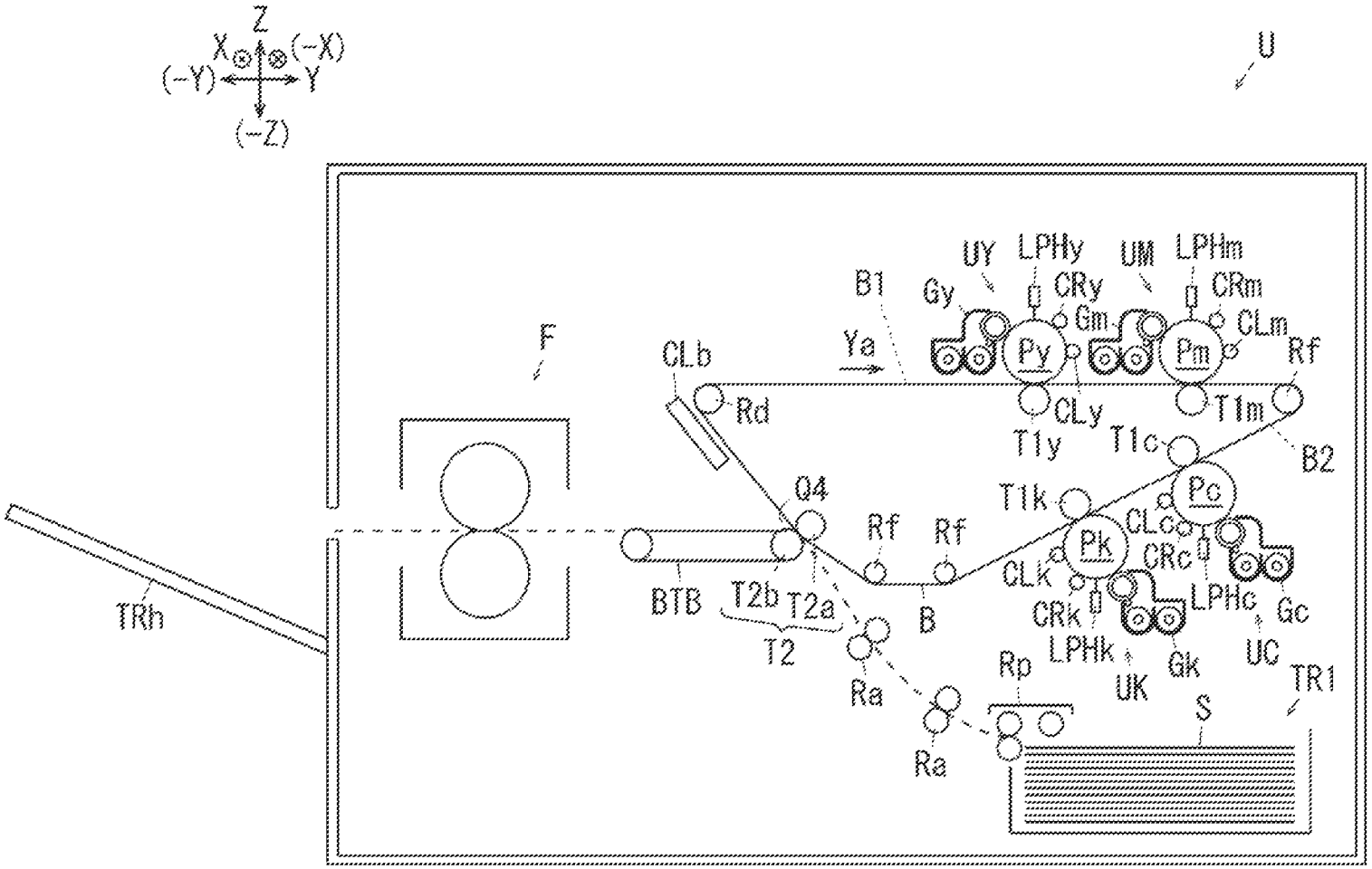
FIG. 1 illustrates an image forming apparatus according to the exemplary embodiment of the present disclosure.

To help understand the following description, FIG. 1 is provided with an X axis representing the front-to-rear direction (the width direction of a medium), a Y axis representing the side-to-side direction (the direction in which the medium is transported), a Z axis representing the top-to-bottom direction, and arrows X, −X, Y, −Y, Z, and −Z representing the frontward, rearward, rightward, leftward, upward, and downward directions, respectively.

Furthermore, a circle with a dot is regarded as an arrow representing a direction from the back of the page toward the front of the page, and a circle with a cross is regarded as an arrow representing a direction from the front of the page toward the back of the page.

To help understand the following description, irrelevant elements are not illustrated in the drawings.

Exemplary Embodiment

FIG. 1 illustrates an image forming apparatus according to an exemplary embodiment of the present disclosure.

Referring to FIG. 1, the image forming apparatus according to the exemplary embodiment of the present disclosure is a printer U and includes toner-image-forming devices UY, UM, UC, and UK (exemplary imaging devices). The toner-image-forming device UY is for a yellow (Y) color and forms an image in the Y color in accordance with an image signal for the Y color. Likewise, the toner-image-forming devices UM, UC, and UK form images in magenta (M), cyan (C), and black (K) colors, respectively, in accordance with image signals for the respective colors.

The toner-image-forming devices UY, UM, UC, and UK and a power circuit are controlled in accordance with control signals generated by a controller (an exemplary control unit). The controller controls the timing of forming the images and the timing of supplying power. When the controller according to the exemplary embodiment receives printing information from a personal computer (an exemplary information processor, not illustrated) connected to the printer U, the controller converts the printing information into image signals for the Y, M, C, and K colors and outputs the control signals to the respective toner-image-forming devices UY, UM, UC, and UK.

The toner-image-forming device UY for the Y color includes a photoconductor drum Py (an exemplary image carrying component), a charging device CRy (an exemplary charging component), a drawing device LPHy (an exemplary latent-image-forming component), a developing device Gy (an exemplary developing component), and a drum cleaner CLy (an exemplary cleaning component).

The charging device CRy charges the surface of the photoconductor drum Py.

The drawing device LPHy draws an electrostatic latent image for the Y color on the surface of the photoconductor drum Py in accordance with the printing information.

The developing device Gy develops the latent image on the photoconductor drum Py into an image in the Y color.

The image is thus carried by the photoconductor drum Py is first-transferred to an intermediate transfer belt B by a first transfer device T1*y* (an exemplary first transfer component). The first transfer device T1*y* is provided across the intermediate transfer belt B from the photoconductor drum Py.

The drum cleaner CLy cleans the photoconductor drum Py by removing unwanted matter from the surface of the photoconductor drum Py that has undergone the above first transfer.

As with the toner-image-forming device UY for the Y color, the toner-image-forming devices UM, UC, and UK for the M, C, and K colors include respective photoconductor drums Pm, Pc, and Pk, respective charging devices CRm, CRc, and CRk, and so forth.

In the exemplary embodiment, the intermediate transfer belt B (an exemplary belt component) runs below the toner-image-forming devices UY and UM for the Y and M colors in such a manner as to face the photoconductor drums Py and Pm from below. In the exemplary embodiment, the photoconductor drums Py and Pm for the Y and M colors face a portion B1 of the intermediate transfer belt B. In the portion B1, the outer surface (front face) of the intermediate transfer belt B faces upward. On the other hand, the photoconductor drums Pc and Pk for the C and K colors face a portion B2 of the intermediate transfer belt B. In the portion B2, the outer surface of the intermediate transfer belt B faces downward.

The intermediate transfer belt B is supported by a plurality of supporting components including a driving roller Rd (an exemplary driving component), a backup roller T2*a* (an exemplary counter component), and follower rollers Rf (exemplary follower components). The driving roller Rd rotates by receiving a driving force from a motor (an exemplary drive source, not illustrated). When the driving roller Rd rotates, the intermediate transfer belt B rotates in a rotating direction Ya.

A belt cleaner CLb (an exemplary cleaning component) is provided on the downstream side with respect to a second transfer area Q4 in the rotating direction Ya of the intermediate transfer belt B. The belt cleaner CLb removes residual matter from the surface of the intermediate transfer belt B that has passed through the second transfer area Q4.

The printer U includes at the bottom thereof a sheet tray TR1 (an exemplary storage component). The sheet tray TR1 stores sheets S (exemplary media).

The sheets S in the sheet tray TR1 are fed out one by one by a feeding roller Rp (an exemplary feeding component).

Each sheet S is transported to the second transfer area Q4 by transporting rollers Ra (exemplary transporting components).

A second transfer roller T2*b* (an exemplary second transfer component) is provided across the intermediate transfer belt B from the backup roller T2*a*. The power circuit places a second transfer voltage between the second transfer roller T2*b* and the backup roller T2*a*.

The second transfer roller T2*b* supports a post-transfer transporting belt BTB (an exemplary transporting component) stretched therearound.

A sheet S transported to the second transfer area Q4 by the transporting rollers Ra receives the images from the intermediate transfer belt B when passing through the second transfer area Q4. The sheet S thus having the images is received by the post-transfer transporting belt BTB.

A combination of the backup roller T2*a* and the second transfer roller T2*b* serves as a second transfer device T2 (an exemplary transfer component according to the exemplary embodiment).

The sheet S received by the post-transfer transporting belt BTB is transported to a fixing device F (an exemplary fixing component). The fixing device F fixes the unfixed toners on the surface of the sheet S.

The sheet S having passed through the fixing device F is outputted onto an output tray TRh (an exemplary placing component).

Description of Toner-Image-Forming Devices for Y and M Colors

Figure 2:
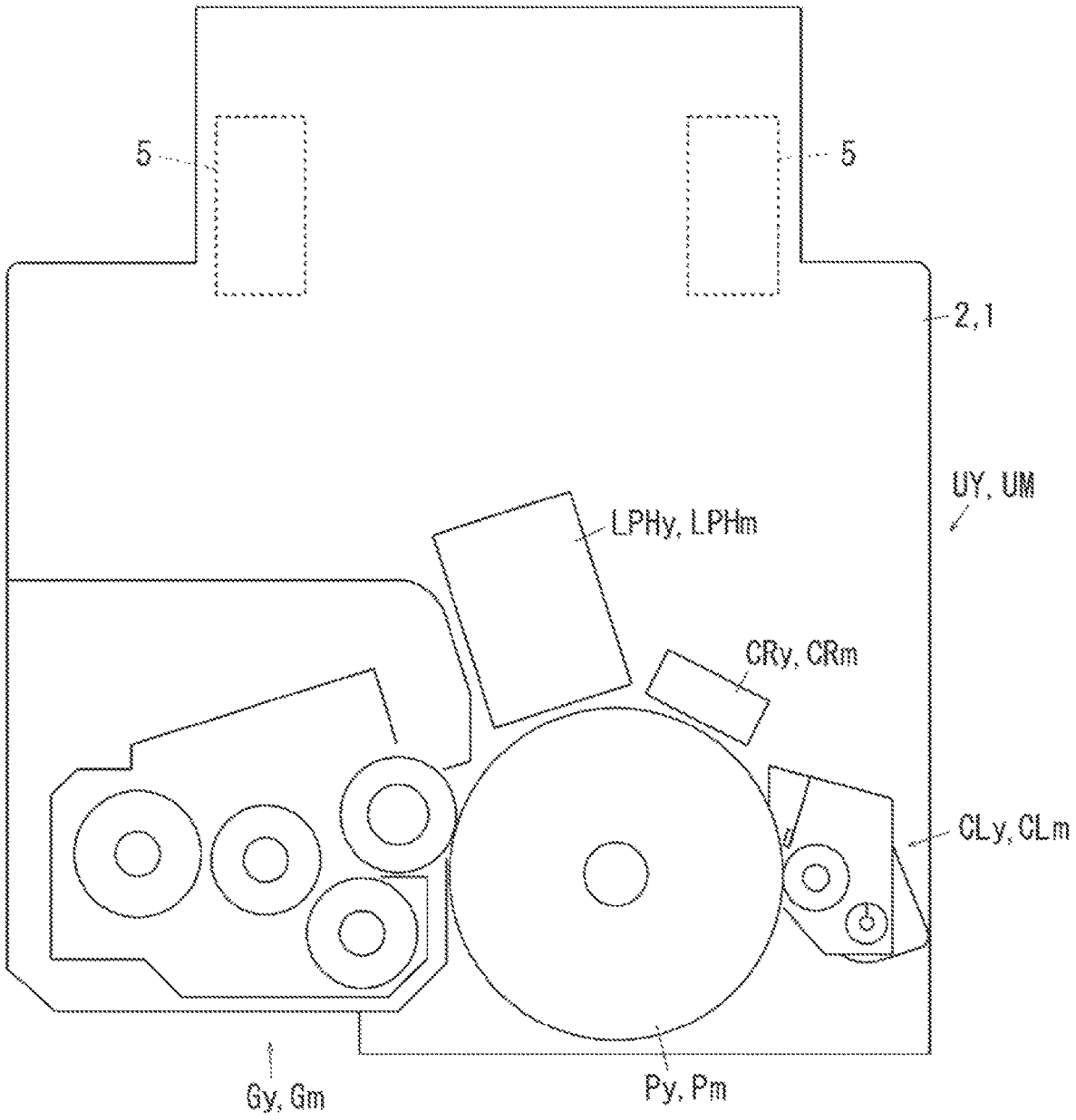
FIG. 2 is an enlargement of a toner-image-forming device for a yellow (Y) color according to the exemplary embodiment.

FIG. 2 is an enlargement of the toner-image-forming device UY for the Y color according to the exemplary embodiment.

Figure 3:
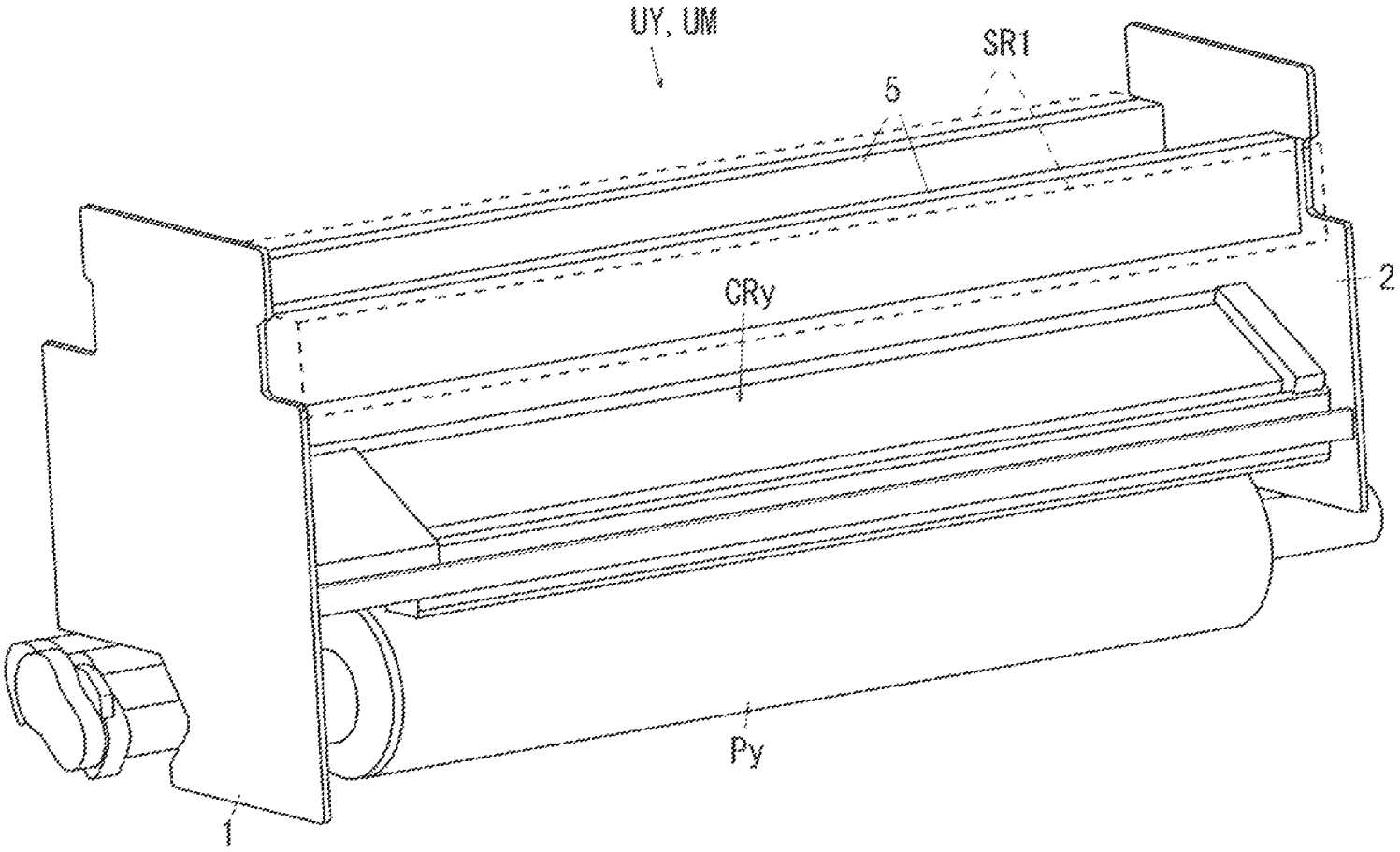
FIG. 3 is a perspective view of the toner-image-forming device for the Y color according to the exemplary embodiment.

FIG. 3 is a perspective view of the toner-image-forming device UY for the Y color according to the exemplary embodiment.

The toner-image-forming devices UY and UM for the Y and M colors will now be described. The toner-image-forming device UM for the M color has the same configuration as the toner-image-forming device UY for the Y color. Therefore, the toner-image-forming device UY for the Y color will be described, and detailed description of the toner-image-forming device UM for the M color is omitted.

Referring to FIGS. 2 and 3, the toner-image-forming device UY for the Y color includes a front plate 1 and a rear plate 2 (exemplary frame members). The photoconductor drum Py, the charging device CRy, the drawing device LPHy, the developing device Gy, and the drum cleaner CLy are positioned between the front plate 1 and the rear plate 2. The photoconductor drum Py (an exemplary first detachable unit), the charging device CRy, the drawing device LPHy, the developing device Gy (a developing unit: an exemplary third detachable unit), and the drum cleaner CLy (a cleaner unit: an exemplary first cleaning component and an exemplary fifth detachable unit) are each supported at the front and rear ends thereof by the front plate 1 and the rear plate 2, respectively.

The front plate 1 and the rear plate 2 support right and left frames 5 (exemplary reinforcing components) at respective upper positions thereof. The frames 5 are supported by right and left slide rails SR1 (exemplary first housing components), respectively. The slide rails SR1 each extend in the front-to-rear direction. The toner-image-forming device UY thus supported by the slide rails SR1 is movable (drawable and loadable) in the front-to-rear direction, i.e., in the axial direction of the photoconductor drum Py, with respect to the body of the printer U. That is, the slide rails SR1 have a function of assisting the drawing and loading of the toner-image-forming device UY from and into the body of the printer U. The photoconductor drum Py, the drum cleaner CLy, and the developing device Gy are detachable as to be described below, with the toner-image-forming device UY being drawn out at the front of the body of the printer U.

Figure 4A:
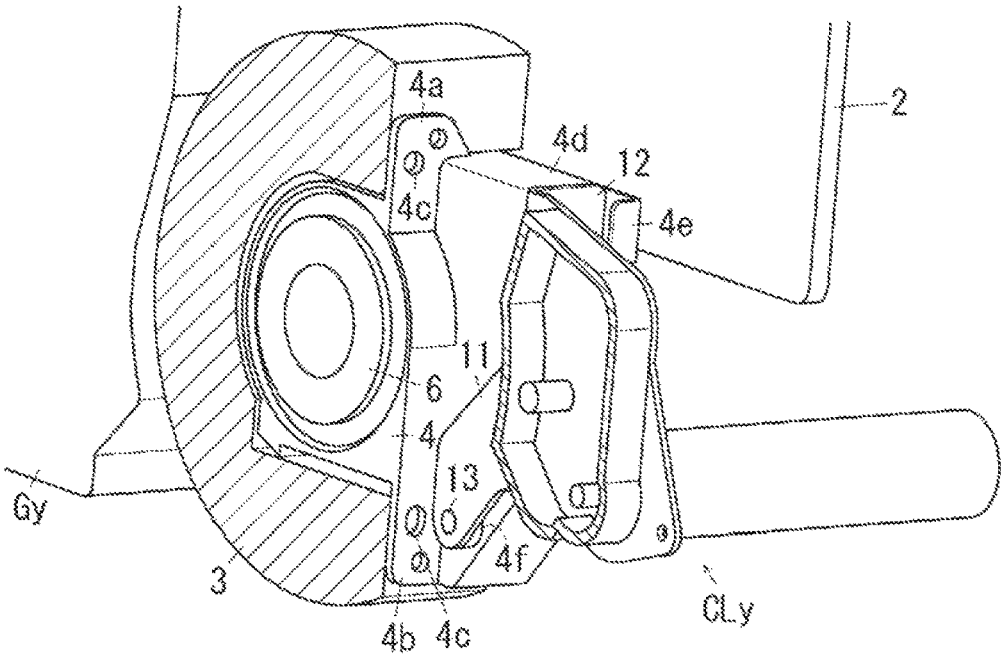
FIG. 4A is an enlargement of the rear end of the toner-image-forming device for the Y color according to the exemplary embodiment, with a drum cleaner screwed thereto.
Figure 4B:
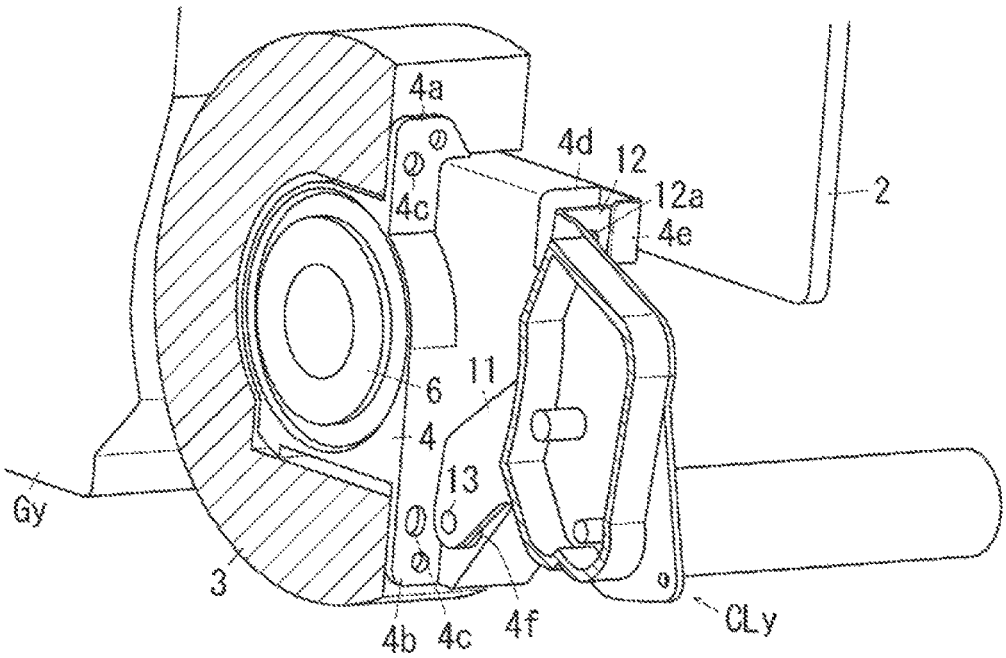
FIG. 4B is an enlargement of the rear end of the toner-image-forming device for the Y color according to the exemplary embodiment, with the drum cleaner unscrewed therefrom.
Figure 4C:
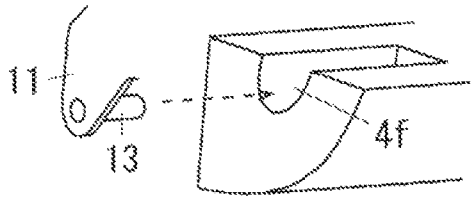
FIG. 4C is an enlargement of a structure where a rotating shaft of the drum cleaner is supported.

FIG. 4A is an enlargement of the rear end of the toner-image-forming device UY for the Y color according to the exemplary embodiment, with the drum cleaner CLy screwed thereto. FIG. 4B is an enlargement of the rear end of the toner-image-forming device UY for the Y color according to the exemplary embodiment, with the drum cleaner CLy unscrewed therefrom. FIG. 4C is an enlargement of a structure where a rotating shaft 13 of the drum cleaner CLy is supported.

Figure 5A:
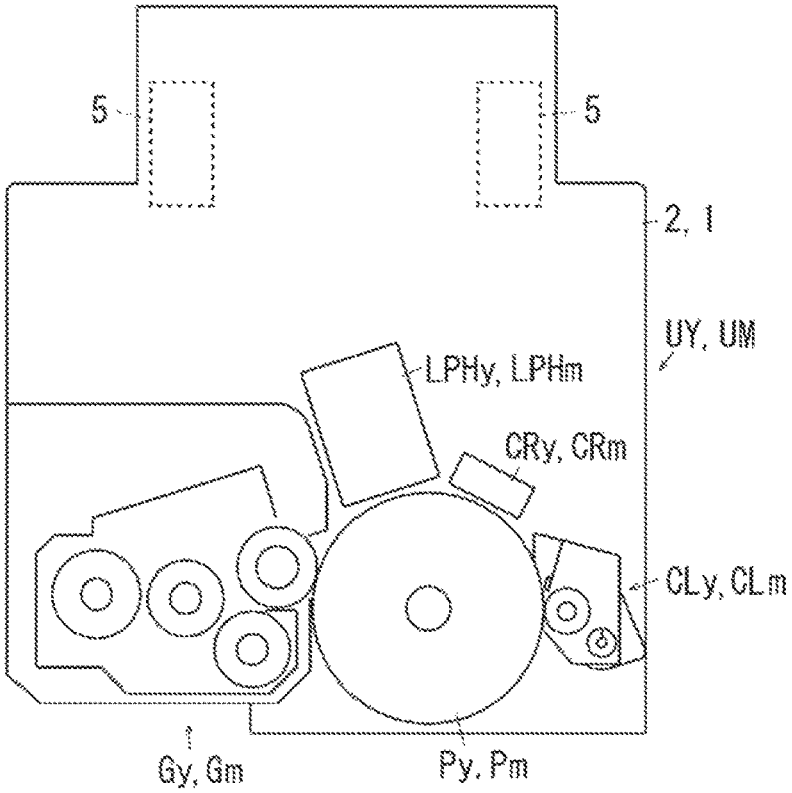
FIG. 5A is a sectional view of the toner-image-forming device for the Y color according to the exemplary embodiment, with relevant elements positioned as illustrated in FIG. 4A.
Figure 5B:
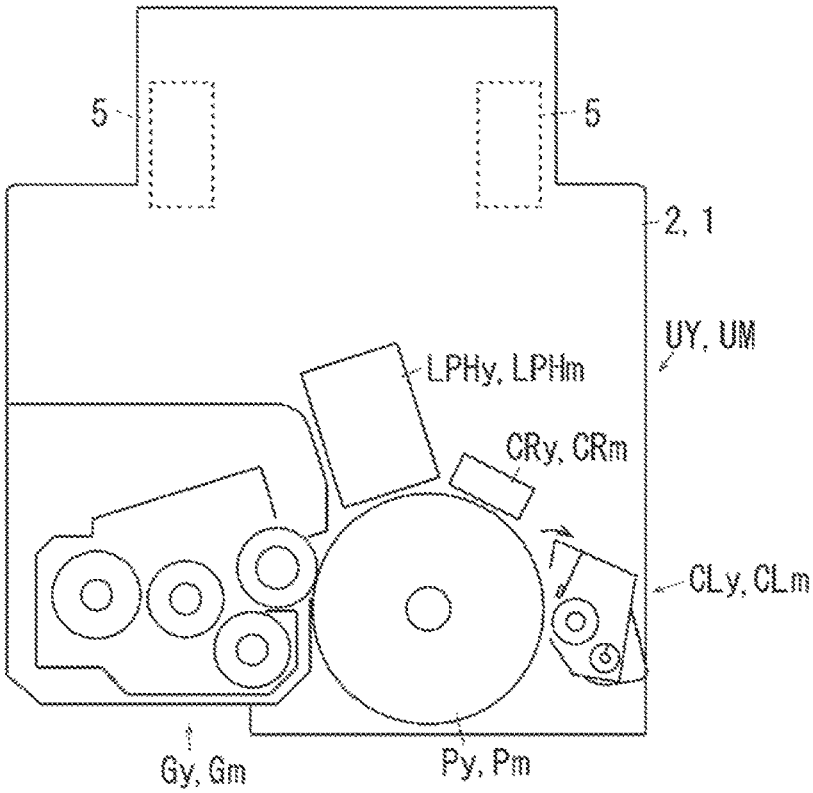
FIG. 5B is a sectional view of the toner-image-forming device for the Y color according to the exemplary embodiment, with relevant elements positioned as illustrated in FIG. 4B.

FIG. 5A is a sectional view of the toner-image-forming device UY for the Y color according to the exemplary embodiment, with relevant elements positioned as illustrated in FIG. 4A. FIG. 5B is a sectional view of the toner-image-forming device UY for the Y color according to the exemplary embodiment, with relevant elements positioned as illustrated in FIG. 4B.

Referring to FIGS. 4A to 5B, the rear plate 2 is provided on the front face thereof with a drum receiving member 3 (an exemplary supporting component for the first detachable unit). The front plate 1 is also provided on the rear face thereof with a drum receiving member of the same kind (not illustrated). The drum receiving member 3 has a U shape that is open on the right side (toward the drum cleaner CLy). The drum receiving member 3 holds a bearing 4 (an exemplary bearing component). The photoconductor drum Py is rotatably supported at a rotating shaft 6 thereof by the bearing 4. The bearing 4 includes on a right part thereof an upper securing plate 4*a*, which extends upward; and a lower securing plate 4*b*, which extends downward. The securing plates 4*a* and 4*b* have screw holes 4*c*, where the bearing 4 is securable to the drum receiving member 3 with screws (not illustrated). That is, when the bearing 4 is screwed to the drum receiving member 3, the photoconductor drum Py is secured to the rear plate 2 (the front plate 1). When the bearing 4 is unscrewed from the drum receiving member 3, the photoconductor drum Py is allowed to be detached from the rear plate 2 (the front plate 1).

The bearing 4 further includes a cleaner securing portion 4*d* (an exemplary securing portion for the fifth detachable unit). The cleaner securing portion 4*d* is positioned on the right side with respect to the upper securing plate 4*a*. The cleaner securing portion 4*d* has a stopper 4*e* (an exemplary retaining component and an exemplary rotation preventing component). Referring to FIGS. 4A and 4B, the stopper 4*e* is a plate member extending rightward (toward the drum cleaner CLy) from the cleaner securing portion 4*d*, with the right end thereof folded. The retaining component may be any component that is configured to retain the cleaning component, which has an opening that originally faces toward the photoconductor drum Py, in an orientation in which the opening faces relatively upward.

The bearing 4 further includes a cleaner bearing 4*f* (an exemplary rotation supporting member for the fifth detachable unit). The cleaner bearing 4*f* resides below the cleaner securing portion 4*d* and nearer to the rotating shaft 6 than the cleaner securing portion 4*d*. Referring to FIG. 4C, the cleaner bearing 4*f* according to the exemplary embodiment is a U-shaped groove that is open on the upper side.

The drum cleaner CLy is provided at the rear end thereof with a securing plate 11 (an exemplary securable object). The drum cleaner CLy is further provided at the front end thereof with a securing plate (not described and not illustrated), which is symmetrical to the securing plate 11.

An upper part of the securing plate 11 forms a securable flange 12. The securable flange 12 is folded in such a manner as to extend face to face with the cleaner securing portion 4*d*. The securable flange 12 has a screw hole 12*a*, where the securable flange 12 is screwable to the cleaner securing portion 4*d* with a screw (not illustrated).

The securing plate 11 is provided in a lower part thereof with the rotating shaft 13, at a position that matches the cleaner bearing 4*f*. The rotating shaft 13 projects rearward from the securing plate 11. The rotating shaft 13 is rotatably supported in the cleaner bearing 4*f*. When the rotating shaft 13 is moved frontward in the axial direction thereof, the rotating shaft 13 comes out of the cleaner bearing 4*f*. The drum cleaner CLy according to the exemplary embodiment is allowed to be detached when rotated such that the opening thereof, which originally faces toward the photoconductor drum Py, is oriented relatively upward.

Hence, in the exemplary embodiment, when the rotating shaft 13 resides in the cleaner bearing 4*f* and the securable flange 12 is screwed to the cleaner securing portion 4*d*, the drum cleaner CLy is secured to the rear plate 2 (the front plate 1) with the aid of the bearing 4 provided for the photoconductor drum Py.

When the securable flange 12 is unscrewed, the drum cleaner CLy rotates clockwise in front view (the view in FIGS. 5A and 5B), because the rotating shaft 13 is positioned on the lower left side with respect to the center of gravity of the drum cleaner CLy (i.e., nearer to the photoconductor drum Py than and lower than the center of gravity of the drum cleaner CLy). That is, the drum cleaner CLy rotates in a direction in which the securable flange 12 moves away from the cleaner securing portion 4*d*. Thus, the drum cleaner CLy having the opening, which originally faces toward the photoconductor drum Py, rotates such that the opening faces relatively upward.

In the exemplary embodiment, when the drum cleaner CLy rotates about the rotating shaft 13 and the securable flange 12 comes into contact with the stopper 4*e* as illustrated in FIG. 4B, the drum cleaner CLy stops rotating and is retained in that orientation. That is, the drum cleaner CLy is retained in the orientation where the opening thereof faces relatively upward. If the stopper 4*e* is not employed, the drum cleaner CLy may rotate excessively, leading to scattering or leakage of developer from the drum cleaner CLy. In particular, if the drum cleaner CLy is heavy, an accident such as injury to the worker may occur unless the rotation of the drum cleaner CLy is stopped.

Figure 6A:
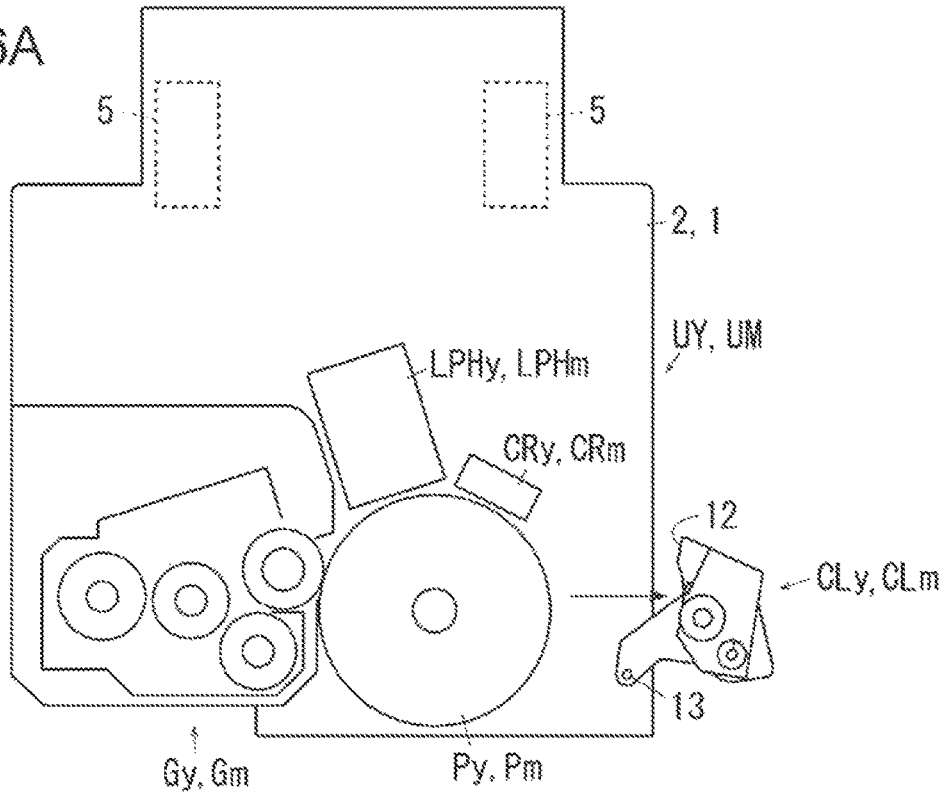
FIG. 6A illustrates a state of the toner-image-forming device for the Y color according to the exemplary embodiment illustrated in FIG. 5B, with the drum cleaner detached therefrom.
Figure 6B:
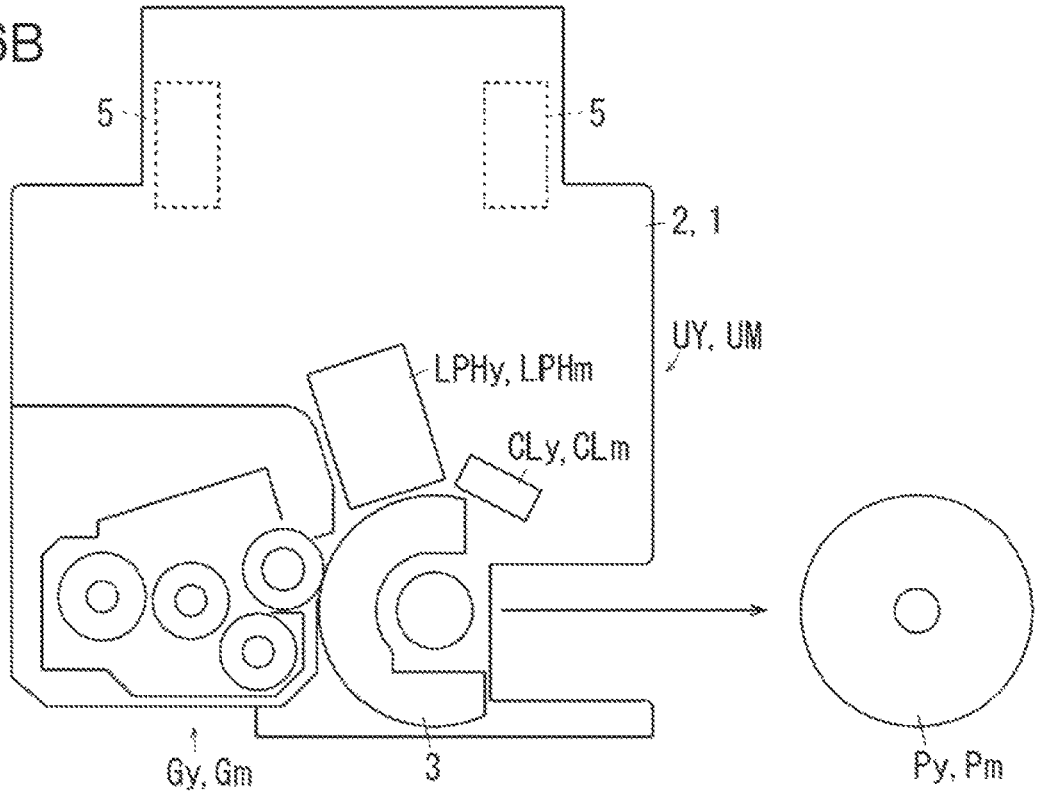
FIG. 6B illustrates a state of the toner-image-forming device for the Y color according to the exemplary embodiment illustrated in FIG. 6A, with a photoconductor drum detached therefrom.

FIG. 6A illustrates a state of the toner-image-forming device UY for the Y color according to the exemplary embodiment illustrated in FIG. 5B, with the drum cleaner CLy detached therefrom. FIG. 6B illustrates a state of the toner-image-forming device UY for the Y color according to the exemplary embodiment illustrated in FIG. 6A, with the photoconductor drum Py detached therefrom.

Referring to FIGS. 6A and 6B, when the drum cleaner CLy that has been rotated as above is lifted, the rotating shaft 13 comes out of the cleaner bearing 4*f* and the securable flange 12 moves away from the stopper 4*e*. Then, when the drum cleaner CLy is moved rightward, i.e., in the side-to-side direction (in the exemplary embodiment, a horizontal direction, for example), the drum cleaner CLy is detached from the rear plate 2 (and the front plate 1). Herein, the term "side-to-side direction" refers to a direction within an angular range of 90 degrees: 45 degrees each on the upper and lower sides with respect to the horizontal direction, which is defined as 0 degrees.

To attach the drum cleaner CLy, the above detaching process is performed in the reverse order.

Referring to FIGS. 6A and 6B, once the drum cleaner CLy is detached, the photoconductor drum Py is allowed to be detached by unscrewing the securing plates 4*a* and 4*b* and moving the photoconductor drum Py rightward, i.e., in the side-to-side direction. In the exemplary embodiment, the photoconductor drum Py for the Y color is detached through a space where the drum cleaner CLy passes when detached.

Figure 7A:
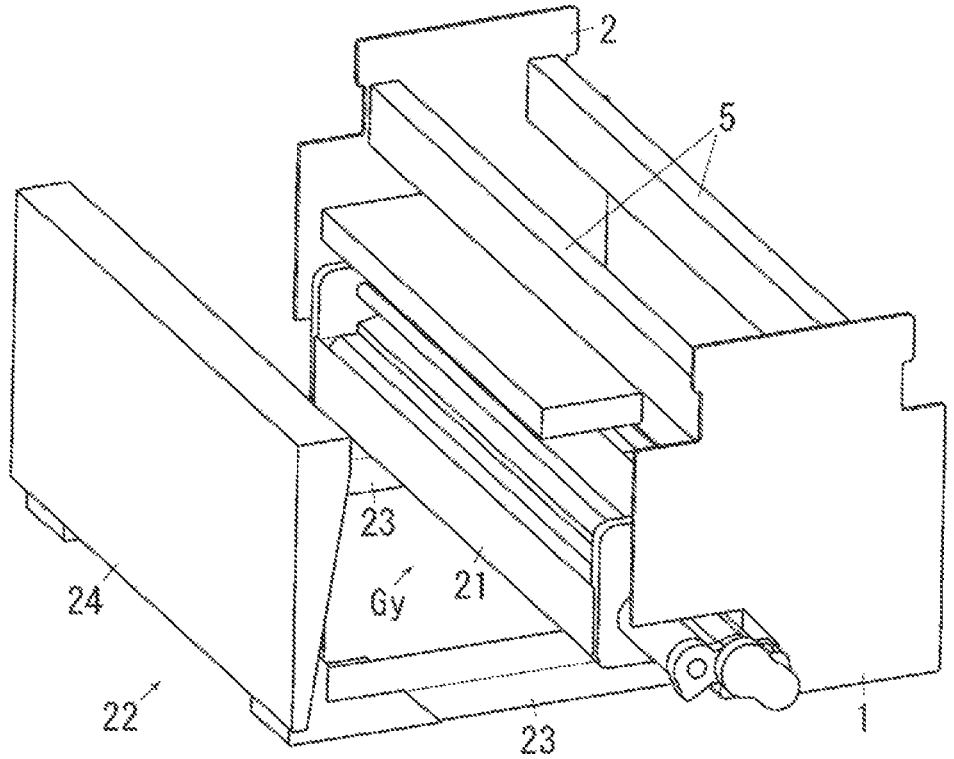
FIG. 7A illustrates the toner-image-forming device for the Y color according to the exemplary embodiment, with a first moving component attached thereto.
Figure 7B:
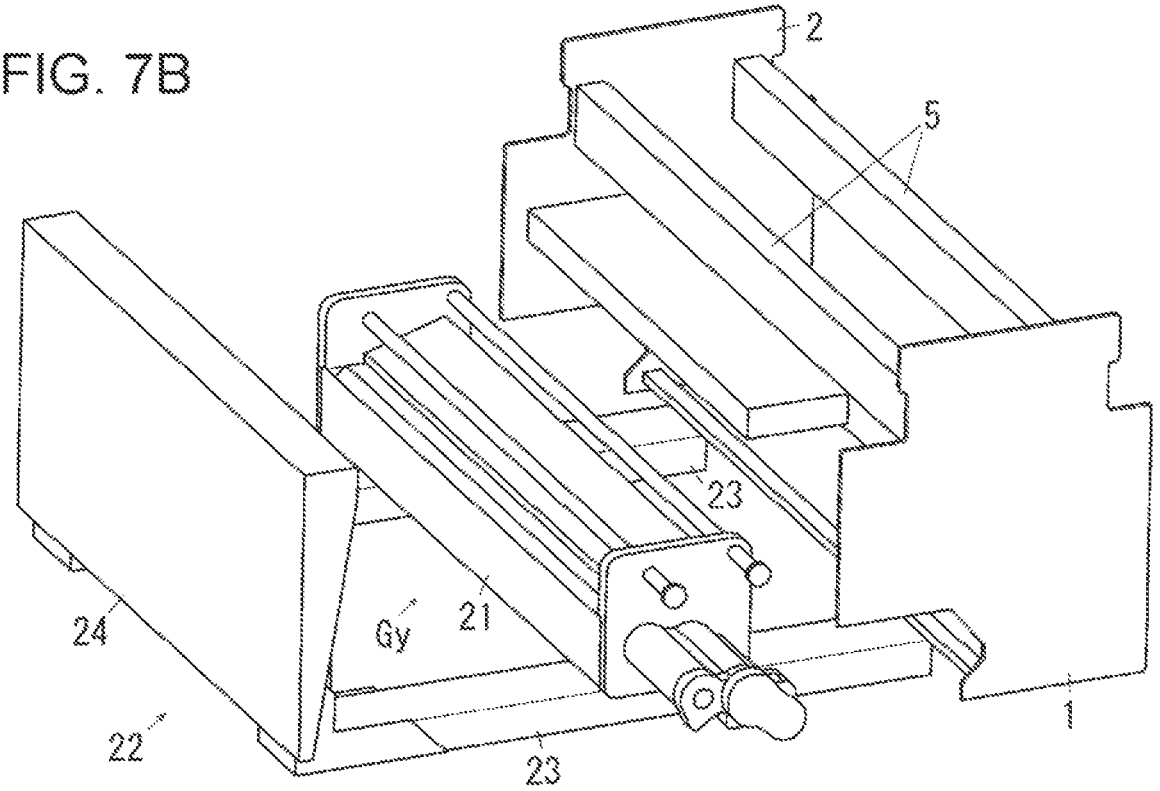
FIG. 7B illustrates a state of the toner-image-forming device for the Y color according to the exemplary embodiment illustrated in FIG. 7A, with a developing device detached therefrom.

FIG. 7A illustrates the toner-image-forming device UY for the Y color according to the exemplary embodiment, with a first moving component attached thereto. FIG. 7B illustrates a state of the toner-image-forming device UY for the Y color according to the exemplary embodiment illustrated in FIG. 7A, with the developing device Gy detached therefrom.

The developing device Gy according to the exemplary embodiment includes a developer container 21 and is secured to the front plate 1 and to the rear plate 2 with screws (not illustrated) at the front end and at the rear end, respectively, of the developer container 21. To move the developing device Gy in the exemplary embodiment, an upper lifter 22 (an exemplary first moving component) is used. The upper lifter 22 includes front and rear supporting members 23. The supporting members 23 support a handle 24 (an exemplary handling portion) at the left ends thereof. Referring to FIG. 7A, the supporting members 23 are positioned in such a manner as to support at the upper surfaces thereof the front and rear ends, respectively, of the developer container 21 from below. Then, the handle 24 is moved leftward. Consequently, the developing device Gy moves leftward as illustrated in FIG. 7B. Thus, the developing device Gy is detached from the front plate 1 and the rear plate 2. To attach the developing device Gy, the above detaching process is performed in the reverse order.

Description of Toner-Image-Forming Devices for C and K Colors

Figure 8:
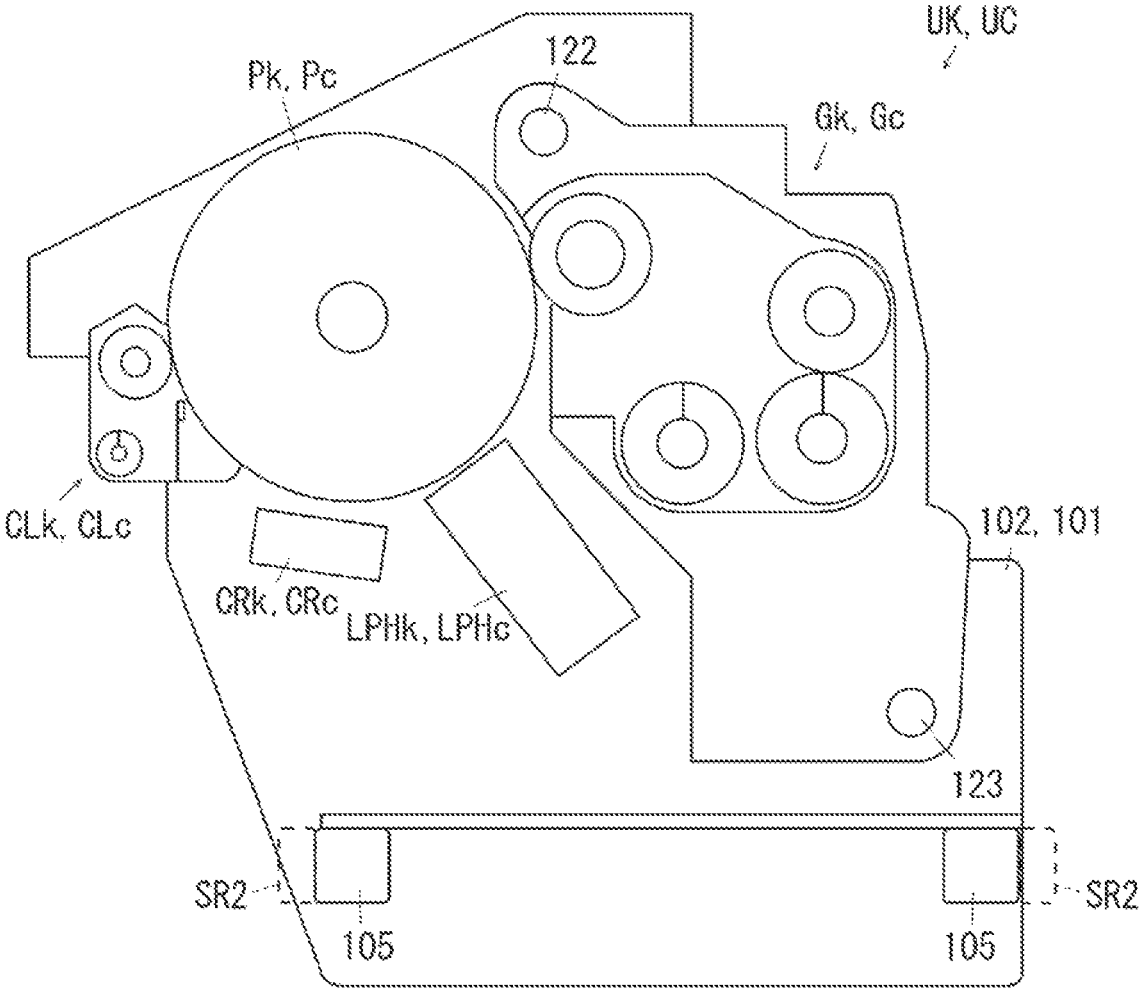
FIG. 8 is an enlargement of a toner-image-forming device for a black (K) color according to the exemplary embodiment.

FIG. 8 is an enlargement of the toner-image-forming device UK for the K color according to the exemplary embodiment.

Figure 9:
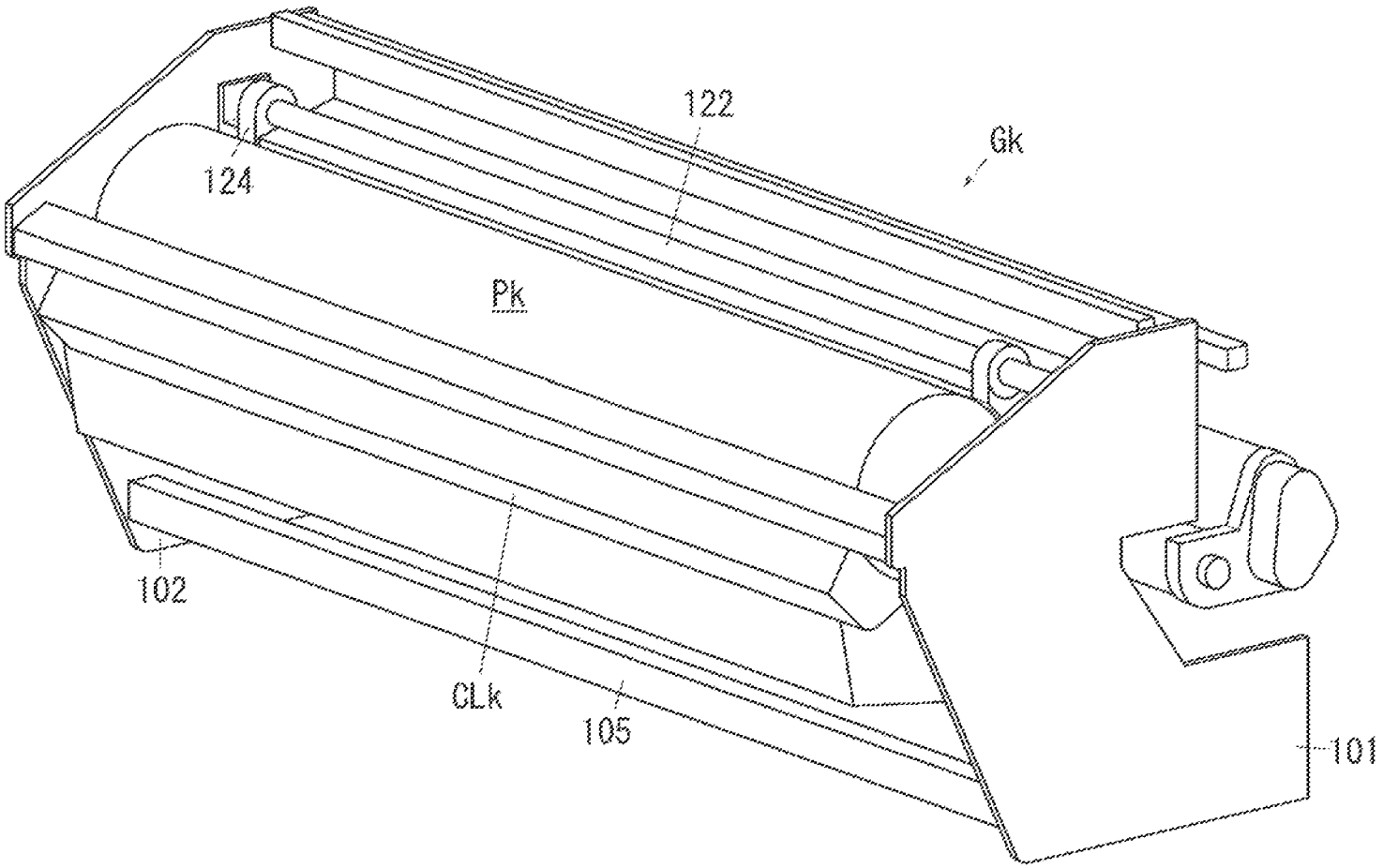
FIG. 9 is a perspective view of the toner-image-forming device for the K color according to the exemplary embodiment.

FIG. 9 is a perspective view of the toner-image-forming device UK for the K color according to the exemplary embodiment.

The toner-image-forming devices UC and UK for the C and K colors will now be described. The toner-image-forming device UC for the C color has the same configuration as the toner-image-forming device UK for the K color. Therefore, the toner-image-forming device UK for the K color will be described, and detailed description of the toner-image-forming device UC for the C color is omitted.

Referring to FIGS. 8 and 9, the toner-image-forming device UK for the K color includes a front plate 101 and a rear plate 102 (exemplary frame members). The photoconductor drum Pk, the charging device CRk, the drawing device LPHk, the developing device Gk, and the drum cleaner CLk are positioned between the front plate 101 and the rear plate 102. The photoconductor drum Pk (an exemplary second detachable unit), the charging device CRk, the drawing device LPHk, the developing device Gk (a developing unit: an exemplary fourth detachable unit), and the drum cleaner CLk (a cleaner unit: an exemplary second cleaning component and an exemplary sixth detachable unit) are each supported at the front and rear ends thereof by the front plate 101 and the rear plate 102, respectively.

The front plate 101 and the rear plate 102 support right and left frames 105 (exemplary reinforcing components) at respective lower positions thereof. The frames 105 are supported by right and left slide rails SR2 (exemplary second housing components), respectively. The slide rails SR2 each extend in the front-to-rear direction. The toner-image-forming device UK thus supported by the slide rails SR2 is movable (drawable and loadable) in the front-to-rear direction, i.e., in the axial direction of the photoconductor drum Pk, with respect to the body of the printer U. That is, the slide rails SR2 have a function of assisting the drawing and loading of the toner-image-forming device UK from and into the body of the printer U. The photoconductor drum Pk, the drum cleaner CLk, and the developing device Gk are detachable as to be described below, with the toner-image-forming device UK being drawn out at the front of the body of the printer U.

Figure 10A:
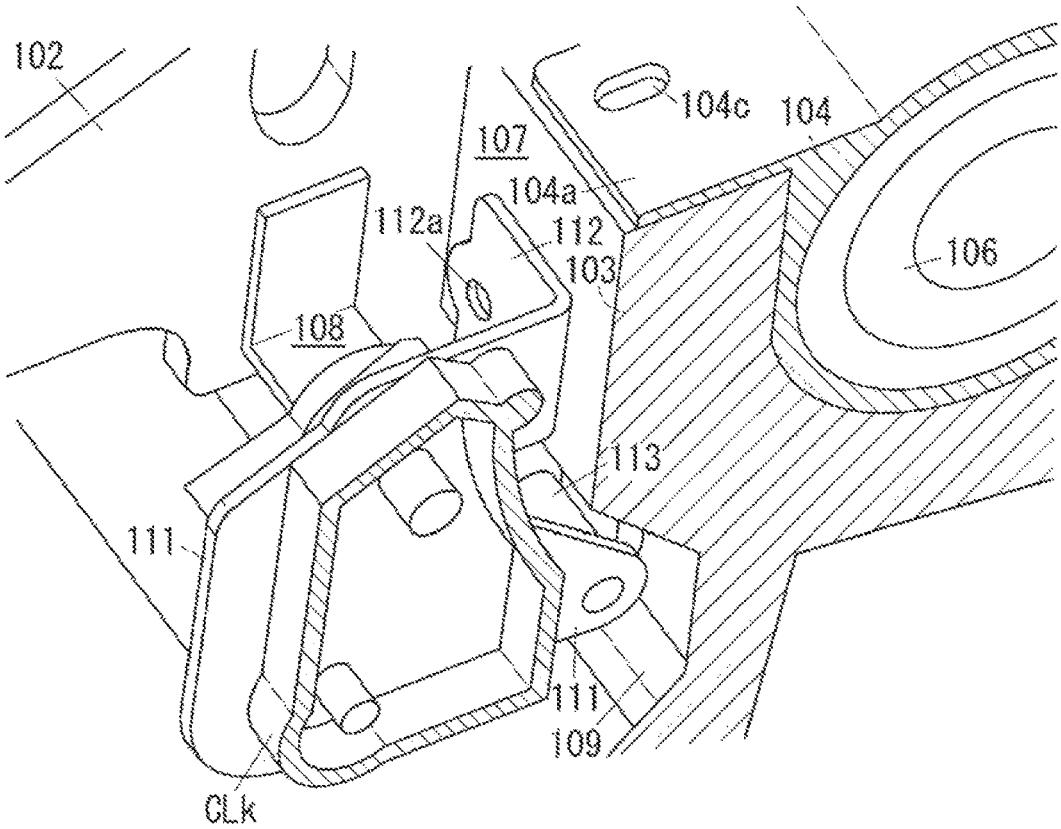
FIG. 10A is an enlargement of the rear end of the toner-image-forming device for the K color according to the exemplary embodiment, with a drum cleaner screwed thereto.
Figure 10B:
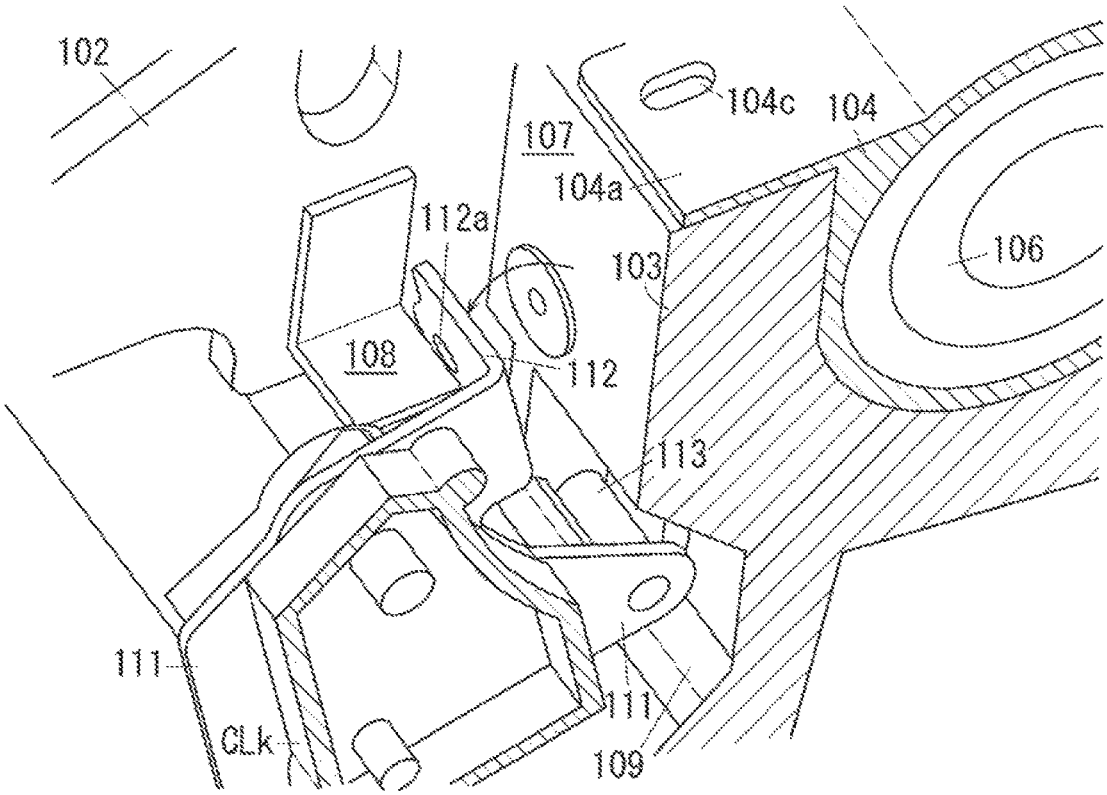
FIG. 10B is an enlargement of the rear end of the toner-image-forming device for the K color according to the exemplary embodiment, with the drum cleaner unscrewed therefrom.

FIG. 10A is an enlargement of the rear end of the toner-image-forming device UK for the K color according to the exemplary embodiment, with the drum cleaner CLk screwed thereto. FIG. 10B is an enlargement of the rear end of the toner-image-forming device UK for the K color according to the exemplary embodiment, with the drum cleaner CLk unscrewed therefrom.

Figure 11A:
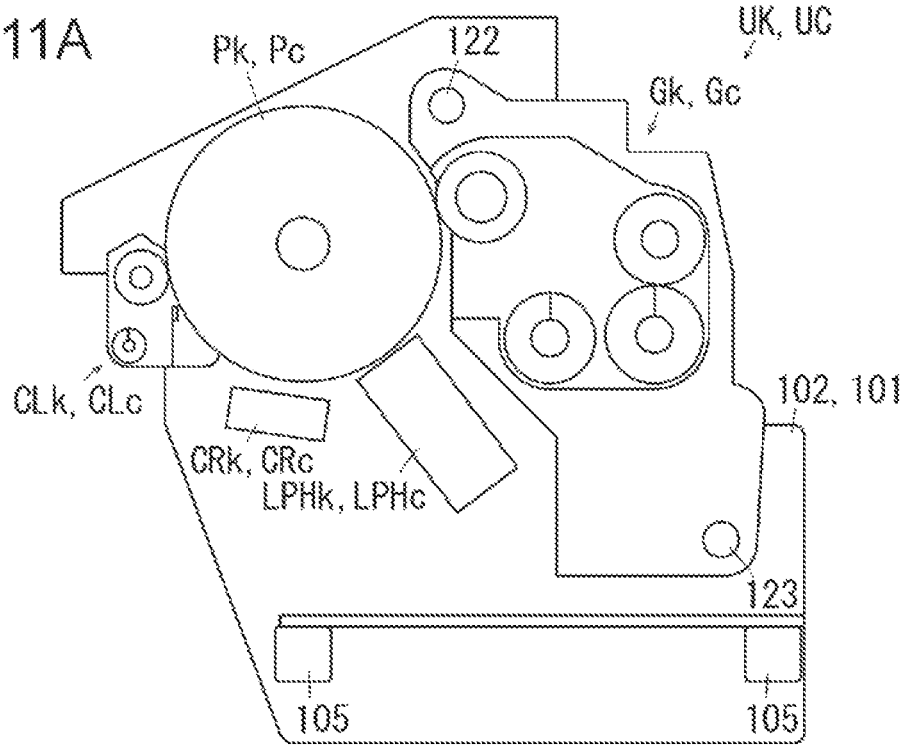
FIG. 11A is a sectional view of the toner-image-forming device for the K color according to the exemplary embodiment, with relevant elements positioned as illustrated in FIG. 10A.
Figure 11B:
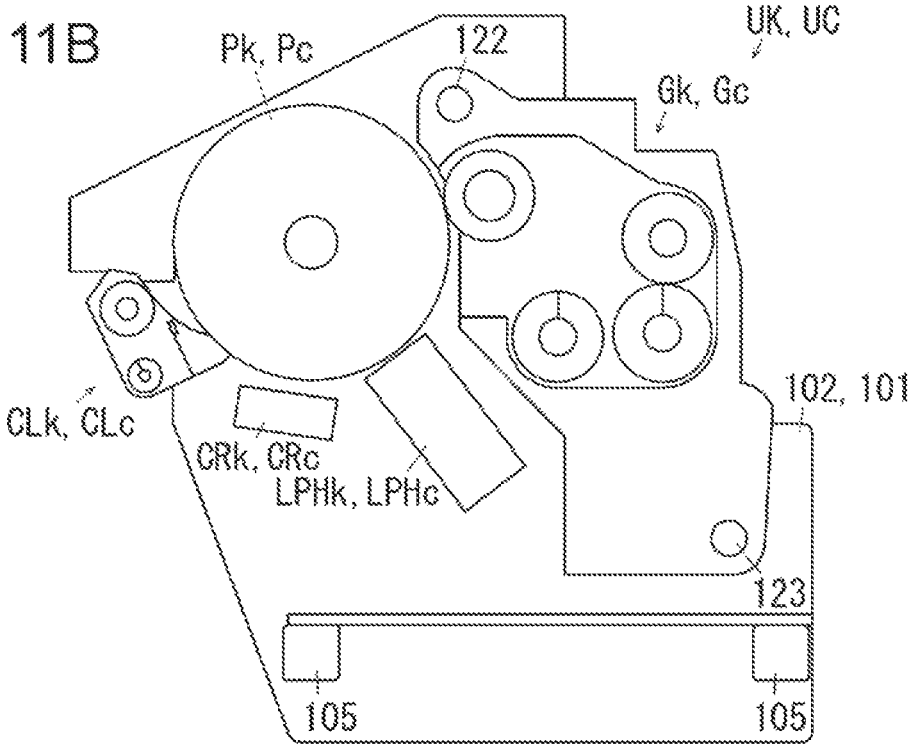
FIG. 11B is a sectional view of the toner-image-forming device for the K color according to the exemplary embodiment, with relevant elements positioned as illustrated in FIG. 10B.

FIG. 11A is a sectional view of the toner-image-forming device UK for the K color according to the exemplary embodiment, with relevant elements positioned as illustrated in FIG. 10A. FIG. 11B is a sectional view of the toner-image-forming device UK for the K color according to the exemplary embodiment, with relevant elements positioned as illustrated in FIG. 10B.

Referring to FIGS. 10 and 11, the rear plate 102 is provided on the front face thereof with a drum receiving member 103 (an exemplary supporting component for the second detachable unit). The front plate 101 is also provided on the rear face thereof with a drum receiving member of the same kind (not illustrated). The drum receiving member 103 has a U shape that is open on the upper side. The drum receiving member 103 holds a bearing 104 (an exemplary bearing component). The photoconductor drum Pk is rotatably supported at a rotating shaft 106 thereof by the bearing 104. The bearing 104 includes at the upper end thereof a securing plate 104*a*, which extends in the side-to-side direction. The securing plate 104*a* has a screw hole 104*c*, where the bearing 4 is securable to the drum receiving member 103 with a screw (not illustrated). That is, when the bearing 104 is screwed to the drum receiving member 103, the photoconductor drum Pk is secured to the rear plate 102 (the front plate 101). When the bearing 104 is unscrewed from the drum receiving member 103, the photoconductor drum Pk is allowed to be detached from the rear plate 102 (the front plate 101).

The left side face of the drum receiving member 103 forms a cleaner securing portion 107 (an exemplary securing portion for the sixth detachable unit). A stopper 108 (an exemplary retaining component and an exemplary rotation preventing component) is provided on the left side with respect to the cleaner securing portion 107. Referring to FIGS. 10A and 10B, the stopper 108 is a plate member supported by the rear plate 102 and is folded in such a manner as to extend frontward.

The drum receiving member 103 includes in a lower left part thereof a cleaner bearing 109 (an exemplary rotation supporting member for the sixth detachable unit). The cleaner bearing 109 resides below the cleaner securing portion 107 and nearer to the rotating shaft 106 than the cleaner securing portion 107. The cleaner bearing 109 according to the exemplary embodiment is a U-shaped groove that is open on the upper side, as with the cleaner bearing 4*f*.

The drum cleaner CLk is provided at the rear end thereof with a securing plate 111 (an exemplary securable object). The drum cleaner CLk is further provided at the front end thereof with a securing plate (not described and not illustrated), which is symmetrical to the securing plate 111.

An upper part of the securing plate 111 forms a securable flange 112. The securable flange 112 is folded in such a manner as to extend face to face with the cleaner securing portion 107. The securable flange 112 has a screw hole 112*a*, where the securable flange 112 is screwable to the cleaner securing portion 107 with a screw (not illustrated).

The securing plate 111 is provided in a lower part thereof with a rotating shaft 113, at a position that matches the cleaner bearing 109. The rotating shaft 113 projects rearward from the securing plate 111. The rotating shaft 113 is rotatably supported in the cleaner bearing 109. When the drum cleaner CLk is lifted, the rotating shaft 113 comes out of the cleaner bearing 109.

Hence, in the exemplary embodiment, when the rotating shaft 113 resides in the cleaner bearing 109 and the securable flange 112 is screwed to the cleaner securing portion 107, the drum cleaner CLk is secured to the rear plate 102 (the front plate 101) with the aid of the bearing 104 provided for the photoconductor drum Pk.

When the securable flange 112 is unscrewed, the drum cleaner CLk rotates counterclockwise in front view (the view in FIGS. 10A to 11B), because the rotating shaft 113 is positioned on the lower right side with respect to the center of gravity of the drum cleaner CLk (i.e., nearer to the photoconductor drum Pk than and lower than the center of gravity of the drum cleaner CLk). That is, the drum cleaner CLk rotates in a direction in which the securable flange 112 moves away from the cleaner securing portion 107. Thus, the drum cleaner CLk having an opening, which originally faces toward the photoconductor drum Pk, rotates such that the opening faces relatively upward.

In the exemplary embodiment, when the drum cleaner CLk rotates about the rotating shaft 113 and the securable flange 112 comes into contact with the stopper 108 as illustrated in FIG. 10B, the drum cleaner CLk stops rotating and is retained in that orientation. That is, the drum cleaner CLk is retained in the orientation where the opening thereof faces relatively upward. If the stopper 108 is not employed, the drum cleaner CLk may rotate excessively, leading to scattering or leakage of developer from the drum cleaner CLk.

When the drum cleaner CLk according to the exemplary embodiment that has been rotated as illustrated in FIGS. 10B and 11B is lifted, the rotating shaft 113 comes out of the cleaner bearing 109 and the securable flange 112 moves away from the stopper 108. Then, when the drum cleaner CLk is moved leftward, i.e., in the side-to-side direction, the drum cleaner CLk moves away from the photoconductor drum Pk, whereby the drum cleaner CLk is detached from the rear plate 102 (and the front plate 101). To attach the drum cleaner CLk, the above detaching process is performed in the reverse order.

Figure 12A:
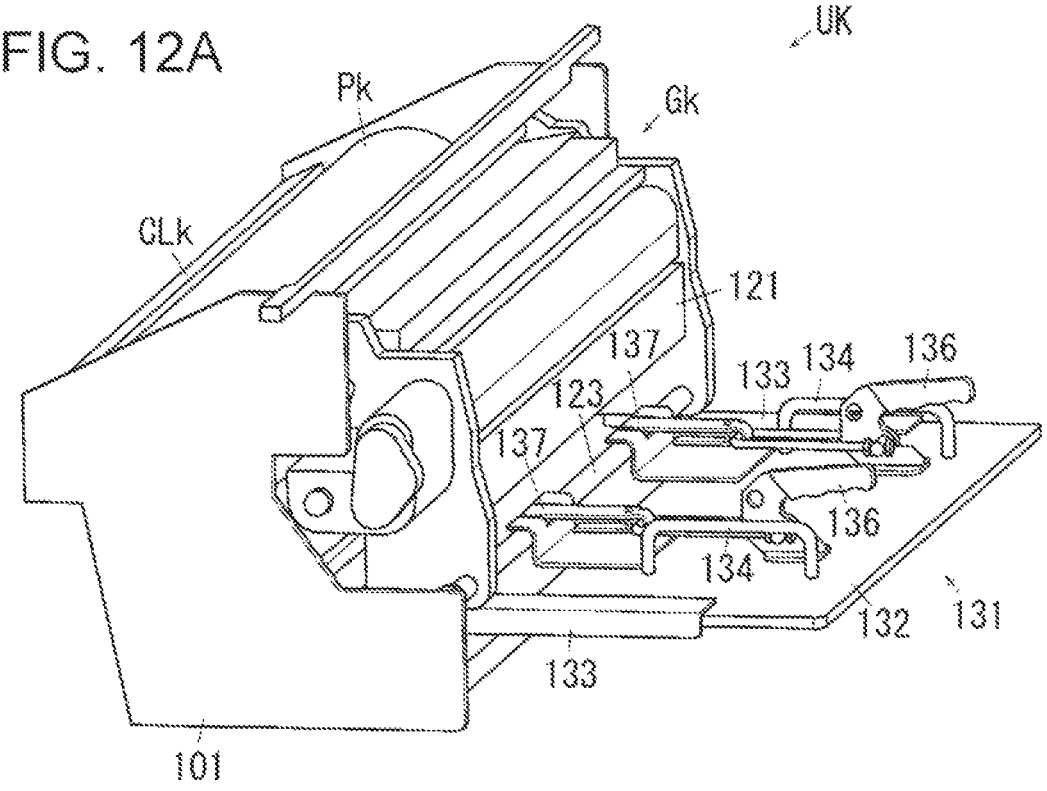
FIG. 12A illustrates the toner-image-forming device for the K color according to the exemplary embodiment, with a second moving component attached thereto.
Figure 12B:
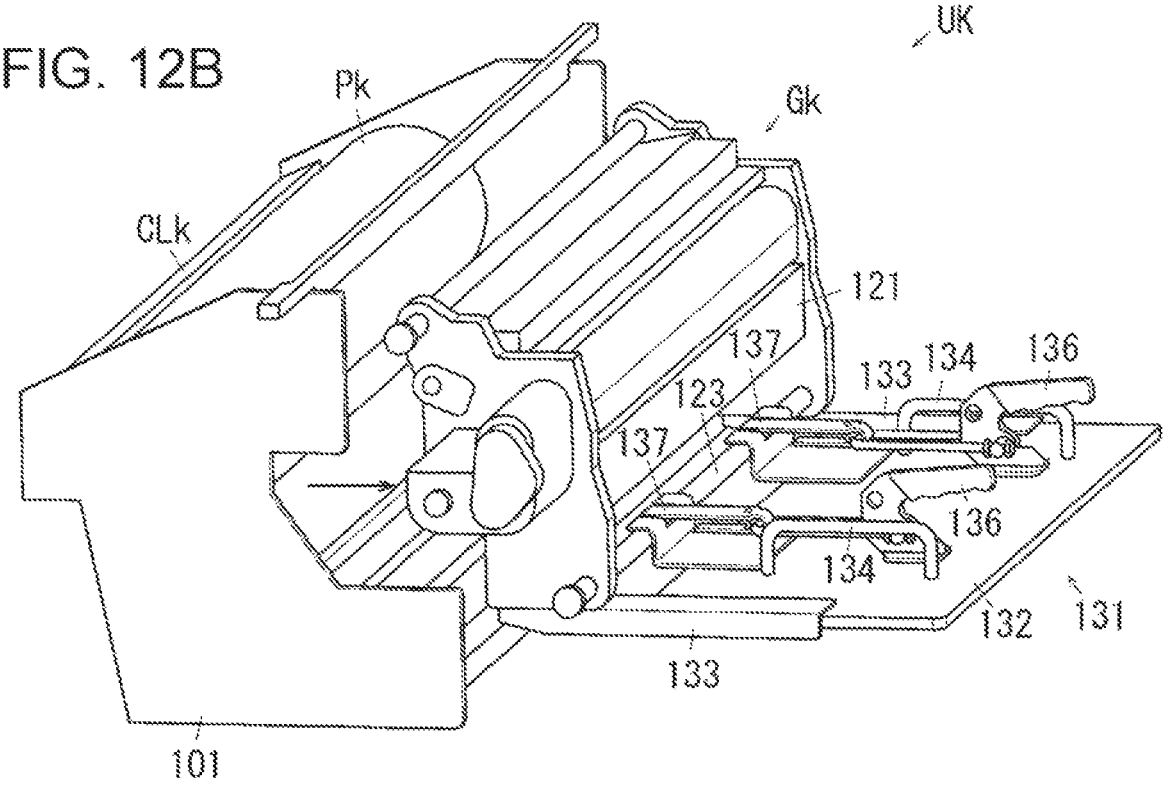
FIG. 12B illustrates a state of the toner-image-forming device for the K color according to the exemplary embodiment illustrated in FIG. 12A, with a developing device detached therefrom.

FIG. 12A illustrates the toner-image-forming device UK for the K color according to the exemplary embodiment, with a second moving component attached thereto. FIG. 12B illustrates a state of the toner-image-forming device UK for the K color according to the exemplary embodiment illustrated in FIG. 12A, with the developing device Gk detached therefrom.

The developing device Gk according to the exemplary embodiment includes a developer container 121 and is secured to the front plate 101 and to the rear plate 102 with screws (not illustrated) at the front end and at the rear end, respectively, of the developer container 121. In the exemplary embodiment, the developer container 121 is supported by positioning shafts 122 and 123 (exemplary positioning components), which extend in the front-to-rear direction and are provided at an upper left position and at a lower right position, respectively, of the developer container 121. The positioning shafts 122 and 123 are positioned by coming into contact with respective positioning members 124 (see FIG. 9, illustrating only an upper rear one), which are provided on each of the front plate 101 and the rear plate 102.

To move the developing device Gk in the exemplary embodiment, a lower lifter 131 (an exemplary second moving component) is used. The lower lifter 131 includes a body plate 132 (an exemplary body member). The body plate 132 is provided with front and rear supporting members 133, which extend toward the developing device Gk. The supporting members 133 are configured to support at the upper surfaces thereof the front and rear ends, respectively, of the developer container 121 from below.

The body plate 132 is provided with handles 134 (exemplary handling components). The body plate 132 is further provided with locking grips 136 (exemplary link operating components). The locking grips 136 are connected to respective toggles 137 (exemplary link components). The toggles 137 operate in conjunction with the locking grips 136 in such a manner as to grab or release the lower positioning shaft 123 (see FIGS. 12A and 12B).

To detach the developing device Gk, the developer container 121 is made to rest at the bottom surface thereof on the upper surfaces of the supporting members 133. Then, the locking grips 136 are operated to grab the lower positioning shaft 123 with the toggles 137, and the lower lifter 131 is moved rightward by using the handles 134. Thus, the developing device Gk is moved rightward (in the side-to-side direction). To attach the developing device Gk, the above detaching process is performed in the reverse order.

Figure 13A:
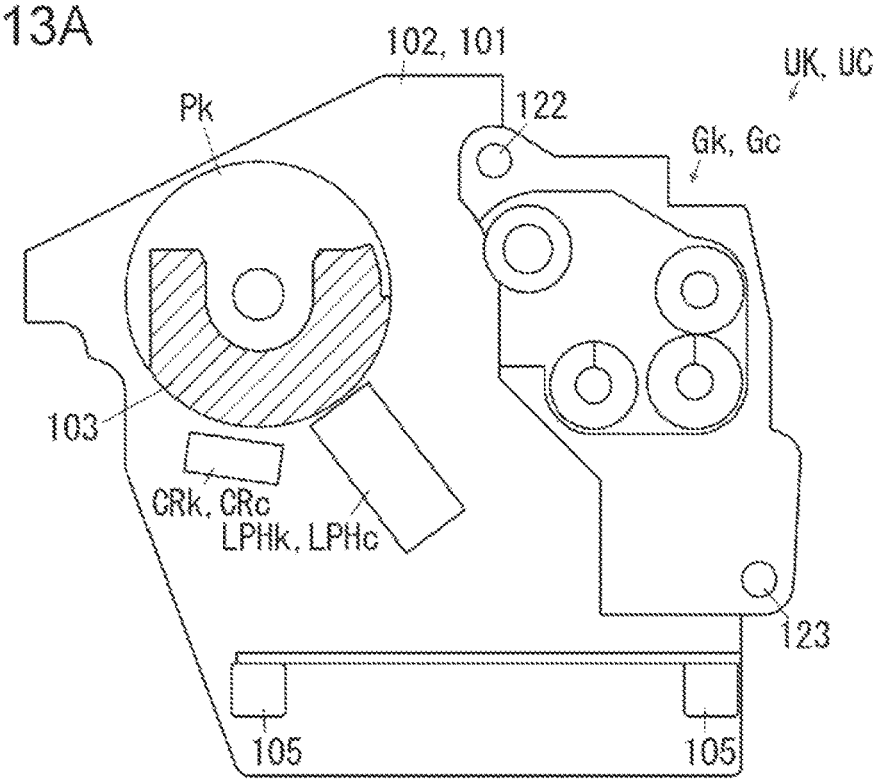
FIG. 13A illustrates the toner-image-forming device for the K color according to the exemplary embodiment, with the developing device moved away from a photoconductor drum.
Figure 13B:
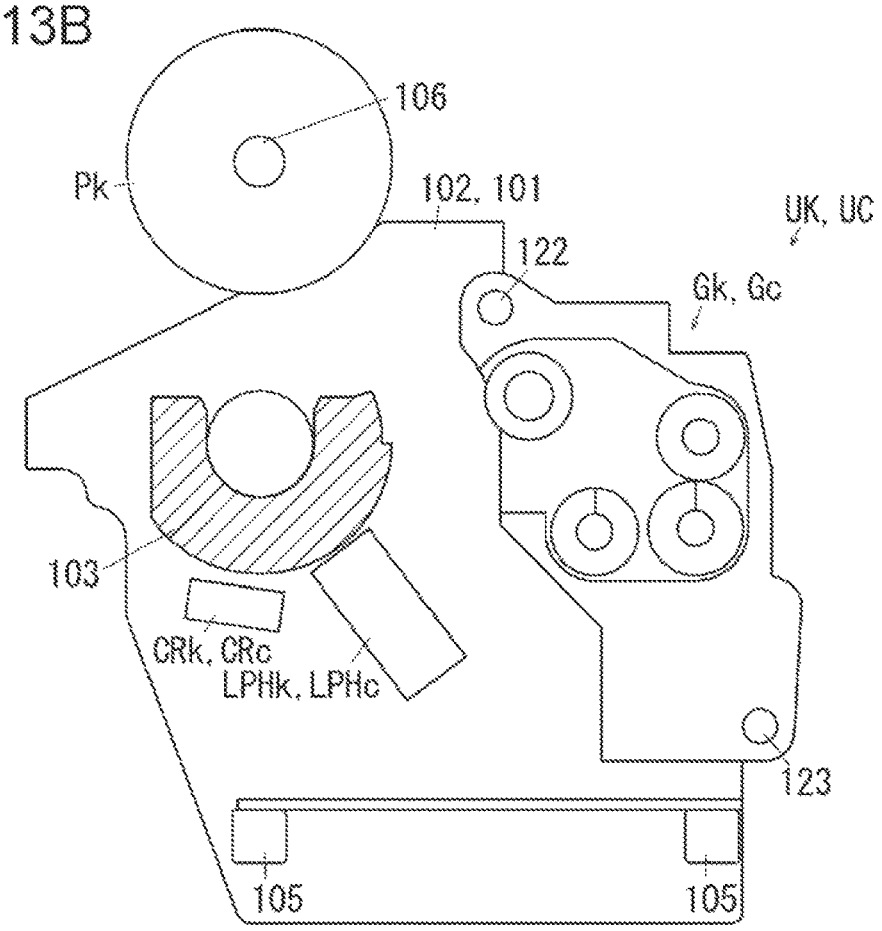
FIG. 13B illustrates a state of the toner-image-forming device for the K color according to the exemplary embodiment illustrated in FIG. 13A, with the photoconductor drum detached therefrom.

FIG. 13A illustrates the toner-image-forming device UK for the K color according to the exemplary embodiment, with the developing device Gk moved away from the photoconductor drum Pk. FIG. 13B illustrates a state of the toner-image-forming device UK for the K color according to the exemplary embodiment illustrated in FIG. 13A, with the photoconductor drum Pk detached therefrom.

Referring to FIGS. 13A and 13B, once the drum cleaner CLk is detached and the developing device Gk is moved away from the photoconductor drum Pk, the photoconductor drum Pk is allowed to be detached by unscrewing the securing plate 104*a* and moving the photoconductor drum Pk upward. In the exemplary embodiment, the photoconductor drum Pk for the K color is detachable and attachable in the top-to-bottom direction, unlike the case of the developing device Gk and the drum cleaner CLk, which are detachable and attachable in the side-to-side direction. Herein, the term "upward" refers to a direction within an angular range of 90 degrees: 45 degrees each on the right and left sides with respect to the 12-o'clock direction (the upward direction exactly opposite to the direction of gravity), which is defined as 0 degrees.

Functions of Exemplary Embodiment

In the printer U according to the exemplary embodiment, the toner-image-forming devices UY and UM for the Y and M colors that face the upward outer surface of the intermediate transfer belt B include the photoconductor drums Py and Pm that are detachable in the side-to-side direction, and the developing devices Gy and Gm and the drum cleaners CLy and CLm that are also detachable in the side-to-side direction. On the other hand, the toner-image-forming devices UC and UK for the C and K colors that face the downward outer surface of the intermediate transfer belt B include the photoconductor drums Pc and Pk that are detachable in the top-to-bottom direction, and the developing devices Gc and Gk and the drum cleaners CLc and CLk that are detachable in the side-to-side direction.

In the printer U, which is intended for high-speed printing and is of a large size, the diameters of the photoconductor drums Py, Pm, Pc, and Pk tend to be large, which increases the sizes of other elements including the developing devices Gy, Gm, Gc, and Gk, and the intermediate transfer belt B. Therefore, individual components and units tend to be heavy and to occupy large spaces. If all the four photoconductor drums Py, Pm, Pc, and Pk having such large diameters are arranged side by side along the upward outer surface of the intermediate transfer belt B, the printer U becomes too long in the side-to-side direction. Accordingly, a long intermediate transfer belt B is to be prepared.

In view of such a situation, according to the exemplary embodiment, two of the toner-image-forming devices UY, UM, UC, and UK are positioned to face the upward outer surface of the intermediate transfer belt B, and the other two are positioned to face the downward outer surface of the intermediate transfer belt B.

In terms of standardization of components, it is general that the photoconductor drums Py, Pm, Pc, and Pk of the four toner-image-forming devices UY, UM, UC, and UK all employ the same detachable mechanism. However, if the lower toner-image-forming devices UC and UK for the C and K colors are configured such that the photoconductor drums Pc and Pk thereof are to be drawn in the side-to-side direction as with the case of the upper toner-image-forming devices UY and UM, the ease of maintenance work such as the work of exchanging components may be reduced. Specifically, if the upper toner-image-forming devices UY and UM are designed to be at a height of, for example, 120 cm from the floor level, which is a suitable height for maintenance work, the lower toner-image-forming devices UC and UK are to be provided at a low position (for example, 30 cm from the floor level). In such a situation, the worker needs to bend his/her body to draw the photoconductor drum Pc or Pk in the side-to-side direction, which may reduce the ease of work. On the other hand, if the upper toner-image-forming devices UY and UM are configured such that the photoconductor drums Py and Pm thereof are detachable in the upward direction as with the case of the lower toner-image-forming devices UC and UK for the C and K colors, the photoconductor drums Py and Pm need to be lifted from the high position (120 cm from the floor level), which reduces the ease of work.

Individual components of the printer U, which has a large size, tend to be heavy: the photoconductor drums Py, Pm, Pc, and Pk each weigh about 10 kg; the drum cleaners CLy, CLm, CLc, and CLk each weigh about 5 to 6 kg; the developing devices Gy, Gm, Gc, and Gk each weigh about 50 kg; the drawing devices LPHy, LPHm, LPHc, and LPHk each weigh about 22 kg; and the belt unit including the intermediate transfer belt B weighs about 200 kg. Lifting the photoconductor drums Py, Pm, Pc, or Pk each weighing about 10 kg from a high position puts a great load on the worker.

In view of such a situation, according to the exemplary embodiment, the photoconductor drums Py and Pm of the upper toner-image-forming devices UY and UM are configured to be detachable in the side-to-side direction, whereas the photoconductor drums Pc and Pk of the lower toner-image-forming devices UC and UK are configured to be detachable in the upward direction.

According to the exemplary embodiment, the developing devices Gy, Gm, Gc, and Gk are configured to be detachable in the side-to-side direction. As described above, the developing devices Gy, Gm, Gc, and Gk are much heavier than the photoconductor drums Py, Pm, Pc, and Pk and are difficult to lift by one worker. Therefore, the developing devices Gy, Gm, Gc, and Gk are configured to be detachable by being moved in the side-to-side direction, not in the upward direction, so as to be movable with a force smaller than a force of lifting such a heavy load. Furthermore, according to the exemplary embodiment, the developing devices Gy, Gm, Gc, and Gk are each configured to be movable by using the lifter 22 or 131.

According to the exemplary embodiment, the drum cleaners CLy, CLm, CLc, and CLk are configured to be detachable independently of the photoconductor drums Py, Pm, Pc, and Pk.

According to the exemplary embodiment, the drum cleaners CLy and CLm of the upper toner-image-forming devices UY and UM are configured to be detachable in the side-to-side direction. Furthermore, once the drum cleaners CLy and CLm, which are relatively light components, are detached, the photoconductor drums Py and Pm are detachable without moving the developing devices Gy and Gm, which are heavier than the drum cleaners CLy and CLm.

When the drum cleaners CLy, CLm, CLc, and CLk according to the exemplary embodiment are unscrewed for exchange, the openings thereof, which originally face toward the photoconductor drums Py, Pm, Pc, and Pk, come to face relatively upward.

The drum cleaners CLy, CLm, CLc, and CLk according to the exemplary embodiment are each stopped by the stopper 4*e* or 108 with the opening thereof facing relatively upward. If the drum cleaners CLy, CLm, CLc, and CLk are heavy, a great load is put to the worker who tries to hold the drum cleaner CLy, CLm, CLc, or CLk with the opening thereof facing relatively upward, which reduces the ease of work and may lead to the possibility of accident.

MODIFICATIONS

While an exemplary embodiment of the present disclosure has been described in detail above, the present disclosure is not limited thereto. Various modifications may be made to the above exemplary embodiment within the scope of the present disclosure defined by the appended claims. Modifications (H01) to (H04) of the present disclosure are as follows.

(H01) While the above exemplary embodiment relates to a case where the printer U is an exemplary image forming apparatus, the image forming apparatus is not limited thereto and may be, for example, a copier, a facsimile, or a multifunction machine having some or all of the functions of the foregoing apparatuses.

(H02) While the above exemplary embodiment relates to a case where the toner-image-forming devices UY and UM for the Y and M colors are provided in an area where the outer surface of the intermediate transfer belt B faces upward, whereas the toner-image-forming devices UC and UK for the C and K colors are provided in an area where the outer surface of the intermediate transfer belt B faces downward, the arrangement of the toner-image-forming devices is not limited thereto. For example, the toner-image-forming devices UY, UM, and UC may be provided in the area where the outer surface of the intermediate transfer belt B faces upward, whereas the toner-image-forming device UK alone may be provided in the area where the outer surface of the intermediate transfer belt B faces downward.

(H03) While the above exemplary embodiment relates to a case where the image forming apparatus includes four toner-image-forming devices UY, UM, UC, and UK, the image forming apparatus is not limited thereto and may include toner-image-forming devices for two, three, or five or more colors.

(H04) While the above exemplary embodiment relates to a case where the lifters 22 and 131 are to be used, the lifters 22 and 131 may be omitted. The lifters 22 and 131 described in the above exemplary embodiment are each a tool that enables the worker to carry the developing device with a reduced load. Specifically, the lifters 22 and 131 each have a function that helps the worker place the developing device thereonto while keeping the developing device attached to the image forming apparatus and move the developing device away from the apparatus without lifting the developing device: that is, a function of supporting the moving of the developing device; a function of lifting the developing device; and a function of carrying the developing device with the aid of casters or the like. The tool may have only any one or two of the moving support function, the lifting function, and the carrying function.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a belt component;

a first detachable unit that faces the belt component in an area where an outer surface of the belt component faces upward;

a first housing component that houses the first detachable unit and is drawable from and loadable into the apparatus;

a second detachable unit that faces the belt component in an area where the outer surface of the belt component faces downward; and a second housing component that houses the second detachable unit and is drawable from and loadable into the apparatus, wherein with the first housing component being drawn from the apparatus, the first detachable unit is detachable from and attachable to the first housing component in a side-to-side direction, and wherein with the second housing component being drawn from the apparatus, the second detachable unit is detachable from and attachable to the second housing component in an upward direction.

2. The image forming apparatus according to claim 1, further comprising:

a third detachable unit that faces the first detachable unit and is detachable from and attachable to the first housing component in the side-to-side direction; and a fourth detachable unit that faces the second detachable unit and is detachable from and attachable to the second housing component in the side-to-side direction.

3. The image forming apparatus according to claim 2, wherein the third detachable unit is heavier than the first detachable unit, and wherein the fourth detachable unit is heavier than the second detachable unit.

4. The image forming apparatus according to claim 3, further comprising:

a first moving component to be attached to the third detachable unit when the third detachable unit is to be detached from or attached to the apparatus, the first moving component being configured to move the third detachable unit in the side-to-side direction; and a second moving component to be attached to the fourth detachable unit when the fourth detachable unit is to be detached from or attached to the apparatus, the second moving component being configured to move the fourth detachable unit in the side-to-side direction.

5. The image forming apparatus according to claim 4, wherein the first detachable unit and the second detachable unit each include an image carrying component, and wherein the third detachable unit and the fourth detachable unit each include a developing component.

6. The image forming apparatus according to claim 5, further comprising:

a fifth detachable unit that includes a first cleaning component configured to clean the image carrying component of the first detachable unit, the fifth detachable unit being detachable from and attachable to the first housing component, the first cleaning component having an opening that faces toward the image carrying component;

a sixth detachable unit that includes a second cleaning component configured to clean the image carrying component of the second detachable unit, the sixth detachable unit being detachable from and attachable to the second housing component, the second cleaning component having an opening that faces toward the image carrying component;

a first retaining component configured to retain the first cleaning component in an orientation where the opening of the first cleaning component faces relatively upward, the first cleaning component being configured to take the orientation when the fifth detachable unit is detached; and a second retaining component configured to retain the second cleaning component in an orientation where the opening of the second cleaning component faces relatively upward, the second cleaning component being configured to take the orientation when the sixth detachable unit is detached.

7. The image forming apparatus according to claim 4, wherein the first detachable unit and the second detachable unit each include an image carrying component, wherein the apparatus further includes:

a fifth detachable unit that includes a first cleaning component configured to clean the image carrying component of the first detachable unit, the fifth detachable unit being detachable from and attachable to the first housing component, the first cleaning component having an opening that faces toward the image carrying component;

a sixth detachable unit that includes a second cleaning component configured to clean the image carrying component of the second detachable unit, the sixth detachable unit being detachable from and attachable to the second housing component, the second cleaning component having an opening that faces toward the image carrying component;

a first retaining component configured to retain the first cleaning component in an orientation where the opening of the first cleaning component faces relatively upward, the first cleaning component being configured to take the orientation when the fifth detachable unit is detached; and a second retaining component configured to retain the second cleaning component in an orientation where the opening of the second cleaning component faces relatively upward, the second cleaning component being configured to take the orientation when the sixth detachable unit is detached.

8. The image forming apparatus according to claim 7, wherein the fifth detachable unit is detachable from and attachable to the first housing component in the side-to-side direction, and wherein the sixth detachable unit is detachable from and attachable to the second housing component in the side-to-side direction.

9. The image forming apparatus according to claim 3, wherein the first detachable unit and the second detachable unit each include an image carrying component, and wherein the third detachable unit and the fourth detachable unit each include a developing component.

10. The image forming apparatus according to claim 9, further comprising:

a fifth detachable unit that includes a first cleaning component configured to clean the image carrying component of the first detachable unit, the fifth detachable unit being detachable from and attachable to the first housing component, the first cleaning component having an opening that faces toward the image carrying component;

a sixth detachable unit that includes a second cleaning component configured to clean the image carrying component of the second detachable unit, the sixth detachable unit being detachable from and attachable to the second housing component, the second cleaning component having an opening that faces toward the image carrying component;

a first retaining component configured to retain the first cleaning component in an orientation where the opening of the first cleaning component faces relatively upward, the first cleaning component being configured to take the orientation when the fifth detachable unit is detached; and a second retaining component configured to retain the second cleaning component in an orientation where the opening of the second cleaning component faces relatively upward, the second cleaning component being configured to take the orientation when the sixth detachable unit is detached.

11. The image forming apparatus according to claim 3, wherein the first detachable unit and the second detachable unit each include an image carrying component, wherein the apparatus further includes:

a fifth detachable unit that includes a first cleaning component configured to clean the image carrying component of the first detachable unit, the fifth detachable unit being detachable from and attachable to the first housing component, the first cleaning component having an opening that faces toward the image carrying component;

a sixth detachable unit that includes a second cleaning component configured to clean the image carrying component of the second detachable unit, the sixth detachable unit being detachable from and attachable to the second housing component, the second cleaning component having an opening that faces toward the image carrying component;

a first retaining component configured to retain the first cleaning component in an orientation where the opening of the first cleaning component faces relatively upward, the first cleaning component being configured to take the orientation when the fifth detachable unit is detached; and a second retaining component configured to retain the second cleaning component in an orientation where the opening of the second cleaning component faces relatively upward, the second cleaning component being configured to take the orientation when the sixth detachable unit is detached.

12. The image forming apparatus according to claim 11, wherein the fifth detachable unit is detachable from and attachable to the first housing component in the side-to-side direction, and wherein the sixth detachable unit is detachable from and attachable to the second housing component in the side-to-side direction.

13. The image forming apparatus according to claim 2, wherein the first detachable unit and the second detachable unit each include an image carrying component, and wherein the third detachable unit and the fourth detachable unit each include a developing component.

14. The image forming apparatus according to claim 13, further comprising:

a fifth detachable unit that includes a first cleaning component configured to clean the image carrying component of the first detachable unit, the fifth detachable unit being detachable from and attachable to the first housing component, the first cleaning component having an opening that faces toward the image carrying component;

a sixth detachable unit that includes a second cleaning component configured to clean the image carrying component of the second detachable unit, the sixth detachable unit being detachable from and attachable to the second housing component, the second cleaning component having an opening that faces toward the image carrying component;

a first retaining component configured to retain the first cleaning component in an orientation where the opening of the first cleaning component faces relatively upward, the first cleaning component being configured to take the orientation when the fifth detachable unit is detached; and a second retaining component configured to retain the second cleaning component in an orientation where the opening of the second cleaning component faces relatively upward, the second cleaning component being configured to take the orientation when the sixth detachable unit is detached.

15. The image forming apparatus according to claim 14, wherein the fifth detachable unit is detachable from and attachable to the first housing component in the side-to-side direction, and wherein the sixth detachable unit is detachable from and attachable to the second housing component in the side-to-side direction.

16. The image forming apparatus according to claim 2, wherein the first detachable unit and the second detachable unit each include an image carrying component, wherein the apparatus further includes:

a fifth detachable unit that includes a first cleaning component configured to clean the image carrying component of the first detachable unit, the fifth detachable unit being detachable from and attachable to the first housing component, the first cleaning component having an opening that faces toward the image carrying component;

a sixth detachable unit that includes a second cleaning component configured to clean the image carrying component of the second detachable unit, the sixth detachable unit being detachable from and attachable to the second housing component, the second cleaning component having an opening that faces toward the image carrying component;

a first retaining component configured to retain the first cleaning component in an orientation where the opening of the first cleaning component faces relatively upward, the first cleaning component being configured to take the orientation when the fifth detachable unit is detached; and a second retaining component configured to retain the second cleaning component in an orientation where the opening of the second cleaning component faces relatively upward, the second cleaning component being configured to take the orientation when the sixth detachable unit is detached.

17. The image forming apparatus according to claim 16, wherein the fifth detachable unit is detachable from and attachable to the first housing component in the side-to-side direction, and wherein the sixth detachable unit is detachable from and attachable to the second housing component in the side-to-side direction.

18. The image forming apparatus according to claim 1, wherein the first detachable unit and the second detachable unit each include an image carrying component, wherein the apparatus further includes:

a fifth detachable unit that includes a first cleaning component configured to clean the image carrying component of the first detachable unit, the fifth detachable unit being detachable from and attachable to the first housing component, the first cleaning component having an opening that faces toward the image carrying component;

a sixth detachable unit that includes a second cleaning component configured to clean the image carrying component of the second detachable unit, the sixth detachable unit being detachable from and attachable to the second housing component, the second cleaning component having an opening that faces toward the image carrying component;

a first retaining component configured to retain the first cleaning component in an orientation where the opening of the first cleaning component faces relatively upward, the first cleaning component being configured to take the orientation when the fifth detachable unit is detached; and a second retaining component configured to retain the second cleaning component in an orientation where the opening of the second cleaning component faces relatively upward, the second cleaning component being configured to take the orientation when the sixth detachable unit is detached.

19. The image forming apparatus according to claim 18, wherein the fifth detachable unit is detachable from and attachable to the first housing component in the side-to-side direction, and wherein the sixth detachable unit is detachable from and attachable to the second housing component in the side-to-side direction.

20. The image forming apparatus according to claim 18, wherein the first detachable unit is to be detached from and attached to the apparatus through a path where the fifth detachable unit is to be detached from and attached to the apparatus.

* * * * *